US005470688A

United States Patent [19]

Texter et al.

[11] Patent Number: 5,470,688

[45] Date of Patent: Nov. 28, 1995

[54] HEAT DEVELOPMENT OF ELEMENTS CONTAINING METHINE-DYE RELEASING COUPLERS

[75] Inventors: John Texter, Rochester; Thomas R. Welter, Webster; David T. Southby; Jared B. Mooberry, both of Rochester, all of N.Y.

[73] Assignee: Eastman Kodak Company, Rochester, N.Y.

[21] Appl. No.: 250,146

[22] Filed: May 27, 1994

[51] Int. Cl.[6] ..... G03C 8/12; G03C 8/10; G03C 8/40

[52] U.S. Cl. ..... 430/203; 430/226; 430/559; 430/958

[58] Field of Search ..... 430/203, 226, 430/559, 958

[56] References Cited

U.S. PATENT DOCUMENTS

| | | | |
|---|---|---|---|
| 3,743,504 | 7/1973 | Dappen et al. | 430/214 |
| 4,141,730 | 2/1979 | Minagawa et al. | 430/504 |
| 4,248,962 | 2/1981 | Lau | 430/559 |
| 4,420,556 | 12/1983 | Booms et al. | 430/549 |
| 4,483,914 | 11/1984 | Naito et al. | 430/203 |
| 4,507,380 | 3/1985 | Naito et al. | 430/203 |
| 4,584,267 | 4/1986 | Masukawa et al. | 430/203 |
| 4,840,884 | 6/1989 | Mooberry et al. | 430/203 |
| 4,948,698 | 8/1990 | Komamura | 430/203 |
| 5,164,280 | 11/1992 | Texter et al. | 430/203 |
| 5,270,145 | 12/1993 | Willis et al. | 430/203 |
| 5,356,750 | 10/1994 | Texter et al. | 430/203 |
| 5,360,695 | 11/1994 | Texter | 430/203 |

FOREIGN PATENT DOCUMENTS

| | | | |
|---|---|---|---|
| 0155303 | 10/1989 | European Pat. Off. . | |
| 0545433 | 6/1993 | European Pat. Off. | 430/203 |
| 3324533 | 12/1984 | Germany . | |

*Primary Examiner*—Richard L. Schilling
*Attorney, Agent, or Firm*—Paul A. Leipold

[57] ABSTRACT

In accordance with this invention a heat-developable photographic color diffusion transfer element is provided, where this element comprises a dimensionally stable support and one or more layers comprising radiation sensitive silver halide, an organic silver salt oxidizing agent, a reducing agent, a methine-dye releasing compound, and a binder, wherein said methine-dye is heat diffusible in said element, and wherein said methine-dye releasing compound is of the structure Cp—L—M (I)

where

Cp is a coupler radical substituted in the coupling position with a divalent linking group, L;

M is a methine-dye radical exhibiting selective absorption in the visible spectrum; and where the —L—M group couples off upon reaction of said coupler radical with the oxidation product of a primary amine developing agent, and where said methine-dye radical M is released from said —L—M group subsequent to the coupling off of said —L—M group.

26 Claims, No Drawings

HEAT DEVELOPMENT OF ELEMENTS CONTAINING METHINE-DYE RELEASING COUPLERS

RELATED APPLICATIONS

This application is related to the following simultaneously filed, commonly assigned applications: *Methine-Dye Releasing Couplers for Heat Image Separation Systems* of Texter et al., filed May 27, 1994 as (Kodak Attorney Docket No. 66,861B) U.S. application Ser. No. 08/250,145; *Photographic Element Containing a High Dye-Yield Coupler with a Methine Dye Chromophore* of Mooberry et al., filed May 27, 1994 as (Kodak Attorney Docket No. 67,332) U.S. application Ser. No. 08/250,774; *Photographic Element Containing a High Dye-Yield Coupler with Improved Reactivity* of Mooberry et al., filed May 27, 1994 as (Kodak Attorney Docket No. 67,358) U.S. application Ser. No. 08/250,416; *Photographic Element and Process Incorporating a High Dye-Yield Image Coupler Providing Improved Granularity* of Southby et al., filed May 27, 1994 as (Kodak Attorney Docket No. 66,037) U.S. application Ser. No. 08/250,258; *Photographic Element with Silver Halide Emulsion Layer of Low Developability and Having an Associated High Dye-Yield Coupler* of Southby et al., filed May 27, 1994 as (Kodak Attorney Docket No. 66,957) U.S. application Ser. No. 08/250,742; and *Tight-Wrapped Photographic Element Containing a High Dye-Yield Coupler* of Southby and Szajewski, filed May 27, 1994 as (Kodak Attorney Docket No. 69,927) U.S. application Ser. No. 08/250,199. These documents are incorporated herein by reference for all that they disclose about methine dyes.

This application is related to the following commonly assigned applications filed previously: *Dye Releasing Couplers for Heat Image Separation Systems* of Texter et al., filed Dec. 21, 1992 as U.S. application Ser. No. 07/993,580, now U.S. Pat. No. 5,356,750; *Thermal Solvents for Dye Diffusion in Image Separation Systems* of Bailey et al., filed Dec. 6, 1991 as U.S. application Ser. No. 07/804,868; *Thermal Solvents for Heat Image Separation Processes* of Bailey et al., filed Apr. 16, 1993 as U.S. application Ser. No. 08/049,048, now U.S. Pat. No. 5,352,561; *Thermal Solvents for Heat Development Processes* of Bailey et al., filed Dec. 29, 1993 as U.S. application Ser. No. 08/175,002; *Hydrogen Bond Donating/Accepting Thermal Solvents for Image Separation Systems* of Bailey et al., filed Jun. 8, 1993 as U.S. application Ser. No. 08/073,821; *Polymeric Couplers for Heat Image Separation Systems* of Texter et al., filed Aug. 10, 1992 as U.S. application Ser. No. 07/927,691, now U.S. Pat. No. 5,354,642; *Aqueous Developable e Diffusion Transfer Elements Containing Solid Particle Thermal Solvent Dispersions* of Texter, filed Jan. 26, 1993 as U.S. application Ser. No. 08/008,914, now U.S. Pat. No. 5,360,695; *Delamination Systems for Photographic Print Materials* of Lynch and Texter, filed Dec. 7, 1993 as U.S. application Ser. No. 08/163,223, now U.S. Pat. No. 5,368,978; and *Chromogenic Black and White Imaging for Heat Image Separation* of Texter and Willis, filed Dec. 21, 1993 as U.S. application Ser. No. 08/170,601.

FIELD OF THE INVENTION

This invention relates to heat developable photographic systems and processes for forming a dye image. More particularly, this invention relates to heat developable photographic elements and heat development processes for forming dye images in silver halide emulsion layers and to thermal dye-diffusion transfer of image dyes.

BACKGROUND OF THE INVENTION

Photographic heat developable elements and processes have been described in U.S. Pat. Nos. 3,152,904, 3,180,732, 3,301,678, 3,392,020, 3,457,075, 3,531,286, 3,761,270, 3,764,328, 3,985,565, 4,022,617, 4,507,380, 4,536,467, 4,584,267, 4,590,154, 4,595,652, 4,770,989, 4,847,188, and 5,032,499, in United Kingdom Patent Nos. 1,131,108 and 1,167,777, and in *Research Disclosure,* Nos. 12044, 12533, 15108, 15127, 16479, and 17029 (pages 9–15, June 1978).

Diffusible-Dye Releasing Compounds

Dappen and Smith in U.S. Pat. No. 3,743,504 disclose the use of immobile diffusible-dye-forming couplers and immobile diffusible-dye-releasing couplers in a color diffusion transfer system.

Minagawa, Arai, and Ueda in U.S. Pat. No. 4,141,730 disclose the use of immobile colored coupling compounds which release diffusible dye during color development. These compounds are used to advantage in masking applications.

Lau, in U.S. Pat. No. 4,248,962, discloses dye releasing couplers wherein dyes are anchimerically released by coupling-off groups subsequent to reaction of oxidized aromatic amine developers with said couplers.

Sakanoue, Hirano, Adachi, Minami, and Kanagawa in German Offen. No. 3,324,533 A1, Booms and Holstead in U.S. Pat. No. 4,420,556, and Arakawa and Watanabe in European Patent Specification 115,303 B1 disclose the use of diffusible dye forming couplers to provide photographic materials with improved graininess.

Mooberry and Singer, in U.S. Pat. No. 4,840,884, disclose dye-releasing couplers that release electrically neutral dyes and wherein said dyes are released from a coupling-off group comprising a dye and a divalent linking group of the formula —L—NR—, wherein L is a divalent linking group and NR is a substituted nitrogen atom.

Komamura and Ohya, in U.S. Pat. No. 4,847,188, disclose thermally developable light-sensitive materials containing a dye-providing material. Azo-dye releasing couplers and azamethine-dye releasing couplers are disclosed therein.

Naito et al., in U.S. Pat. No. 4,507,380, disclose heat developable light-sensitive materials containing dye-releasing compounds, including styryl dye releasing compounds. Kohno et al., in U.S. Pat. No. 5,032,499, disclose thermal developing light-sensitive materials containing azo-dye releasing compounds.

Texter et al., in U.S. Pat. No. 5,356,750, disclose dye releasing couplers for heat image separation systems, wherein said dyes are exemplified by azo, azamethine, and indoaniline dyes and dye precursors.

Physical Organic Characterization

Materials can be described by a variety of extrathermodynamic properties and parameters to relate their activity, according to some performance measure, to their structure. One of the best known of such classifications is the Hammett substituent constant, as described by L. P. Hammett in *Physical Organic Chemistry* (McGraw-Hill Book Company, New York, 1940) and in other organic text books, monographs, and review articles. These parameters, which characterize the ability of meta and para ring-substituents to affect the electronic nature of a reaction site, were originally quantified by their effect on the $pK_a$ of benzoic acid. Subsequent work has extended and refined the original concept and data, but for the purposes of prediction and correlation, standard sets of such constants, $s_{meta}$ and $s_{para}$, are widely available in the chemical literature, as for example in C. Hansch et al., *J. Med. Chem.*, 17, 1207 (1973).

Another parameter of significant utility relates to the variation in the partition coefficient of a molecule between octanol and water. This is the so-called logP parameter, for the logarithm of the partition coefficient. The corresponding substituent or fragment parameter is the Pi parameter. These parameters are described by C. Hansch and A. Leo in *Substituent Constants for Correlation Analysis in Chemistry and Biology* (John Wiley & Sons, New York, 1969). Calculated logP (often termed cLogP) values are calculated by fragment additivity treatments with the aid of tables of substituent Pi values, or by use of expert programs that calculate octanol/water partition coefficients based on more sophisticated treatments of measured fragment values. An example of the latter is the widely used computer program, *MedChem Software* (Release 3.54, August 1991, Medicinal Chemistry Project, Pomona College, Claremont, Calif.).

The use of these parameters allows one to make quantitative predictions of the performance of a given molecule, and in the present invention, of a given thermal solvent candidate. The Hammett parameters are routinely summed, to give a net electronic effect S, where S is the sum of the respective substituent $s_{meta}$ and $s_{para}$ values. Substituent and fragment parameters are readily available, so that logP and S estimates may be easily made for any prospective molecule of interest.

PROBLEM TO BE SOLVED BY THE INVENTION

Thermally diffusible dyes in heat development elements and processes often suffer from too much unwanted absorption or from too low extinction coefficients, necessitating the use of too much silver or dye-releasing compound to achieve desired densitometry. Such dyes include indoaniline dyes, azo dyes, azamethine dyes, and precursors of such dyes. There is a continuing need for couplers that provide dyes with significantly higher extinction coefficients, so that desired maximum dye densities can be achieved with lower levels of coated coupler and silver, and therefore with lower manufacturing cost.

Prior art dye-releasing compounds often suffer from inadequate reactivity, so that insufficient released dye-density is generated for a given amount of silver reduction. There is a continuing need to provide dye releasing compounds that undergo excellent dye-release kinetics while maintaining satisfactory storage stability.

Prior art dye-releasing compounds suffer form a propensity to thermally diffuse at elevated temperatures, and to thereby provide unwanted color contamination in a non-imagewise fashion to the final dye image, especially when separable dye-receiving layers are used. There is a continuing need to provide dye-releasing compounds that generate diffusible dyes of adequate hue and extinction, but are themselves essentially non-diffusible under thermal activation during heat development or during image dye diffusion transfer.

These and other problems may be overcome by the practice of our invention.

SUMMARY OF THE INVENTION

It is an object of our invention to provide dye-releasing compounds that release methine-dyes of superior hue and extinction.

An object of the present invention is to provide methine-dye releasing compounds of improved reactivity. Yet another object of the present invention is to provide methine-dye releasing compounds that release methine-dye of improved diffusibility.

A further object of the present invention is to provide methine-dye releasing compounds of improved thermal immobility.

In accordance with this invention a heat-developable photographic color diffusion transfer element is provided, where this element comprises a dimensionally stable support and one or more layers comprising radiation sensitive silver halide, an organic silver salt oxidizing agent, a reducing agent, a methine-dye releasing compound, and a binder, wherein said methine-dye is heat diffusible in said element, and wherein said methine-dye releasing compound is of the structure Cp—L—M (I)

where

Cp is a coupler radical substituted in the coupling position with a divalent linking group, L;

M is a methine-dye radical exhibiting selective absorption in the visible spectrum; and where the —L—M group couples off upon reaction of said coupler radical with the oxidation product of a primary amine developing agent, and where said methine-dye radical M is released from said —L—M group subsequent to the coupling off of said —L—M group.

Another embodiment of the present invention provides a heat-developable photographic color diffusion transfer element comprising a dimensionally stable support and one or more layers comprising radiation sensitive silver halide, an organic silver salt oxidizing agent, a reducing agent, a methine-dye releasing compound, a thermal solvent for facilitating the thermal diffusion of methine-dye, and a binder, wherein said methine-dye is heat diffusible in said binder and thermal solvent, and wherein said methine-dye releasing compound is of the structure Cp—L—M (I)

where

Cp is a coupler radical substituted in the coupling position with a divalent linking group, L;

M is a methine-dye radical exhibiting selective absorption in the visible spectrum; and where the -L-M group couples off upon reaction of said coupler radical with the oxidation product of a primary amine developing agent; and where said methine-dye radical M is given by structure (II):

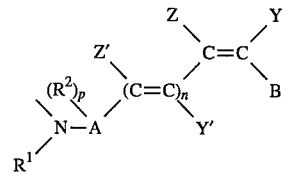

(II)

wherein $R^1$ is hydrogen or a substituted or unsubstituted alkyl or aryl (including heteroaryl) group;

A is a substituted or unsubstituted aryl (including heteroaryl) ring;

each $R^2$ is independently a substituted or unsubstituted alkyl group which may form a ring with Z' or Z when n=0;

p is an integer from 0 to 3;

each Z, Z', and Y' is independently hydrogen or a substituent;

y is an electron withdrawing group;

n is 0, 1, or 2;

B is a heterocycle having the formula (III):

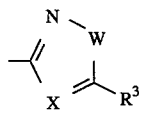

(III)

wherein:

X is O, S, or $N(R^5)$ where $R^5$ is hydrogen or alkyl;

W is N or $C(R^4)$ where $R^4$ is hydrogen or a substituent;

$R^3$ is a substituent linked to the heterocycle by a carbon or nitrogen atom of the substituent;

provided that $R^3$ and $R^4$ may be linked to form a ring.

ADVANTAGEOUS EFFECT OF THE INVENTION

The use of methine-dye releasing couplers provides several important advantages, including being able to design methine-dye releasing couplers wherein it is possible to control independently the properties of the released dye, the properties of the linking and timing chemistry, and the properties of the parent coupler. The incorporation and use of methine-dyes having extremely high extinction coefficients, low unwanted absorption, high thermal diffusibility are particularly attractive advantages provided by the elements and processes of the present invention. Improved color is obtained by using methine-dye releasing compounds of the present invention that incorporate functionality in the linking chemistry and in the coupling chemistry that retard and prevent thermal diffusion of the methine-dye releasing compounds.

DETAILED DESCRIPTION OF THE INVENTION

U.S. Pat. Nos. 3,152,904, 3,180,732, 3,301,678, 3,392,020, 3,457,075, 3,531,286, 3,761,270, 3,764,328, 3,985,565, 4,022,617, 4,507,380, 4,536,467, 4,584,267, 4,590,154, 4,595,652, 4,770,989, 4,847,188, 4,965,181, 4,968,597, 4,968,598, 4,983,494, 5,001,033, 5,004,667, 5,017,454, 5,021,323, 5,028,523, 5,032,487, 5,032,499, 5,041,368, 5,041,369, 5,051,335, 5,051,348, 5,051,349, 5,089,378, and 5,156,939 are incorporated herein by reference for all that they teach about heat development and thermal diffusion of dyes.

The term "nondiffusing" used herein as applied to the couplers and diffusible-dye forming compounds has the meaning commonly applied to the term in color photography and denotes materials, which for all practical purposes, do not migrate or wander through water swollen organic colloid layers, such as gelatin, comprising the sensitive elements of the invention at temperatures of 40° C. and lower. The term "diffusible" as applied to dyes formed from these "nondiffusing" couplers and compounds in the processes has somewhat of a converse meaning and denotes materials having the property of diffusing effectively through relatively dry colloid layers of the sensitive elements in the presence of the "nondiffusing" materials from which they are derived. The terms "dye-receiving" and "image-receiving" are used synonomously herein.

The term "heat developable" as applied to photographic elements herein means that an element contains incorporated developer or reducing agent and incorporated organic silver salt, in addition to at least a catalytic amount of silver halide. This incorporated silver salt generally provides a substantial amount of the silver for oxidizing incorporated developer or reducing agent.

Elements of the present invention also may incorporate heat solvent to facilitate the heat development of incorporated silver halide or organic silver salt. Such heat solvent is generally a polar or high dielectric constant organic material that facilitates the heat development of heat developable elements. The term "heat solvent" is not synonymous with the term "thermal solvent" used herein.

The term "thermal solvent" herein means an organic compound that facilitates the thermal diffusion through relatively dry gelatin or other hydrophilic binder of electrically neutral or uncharged image dyes. Uncharged herein means no net charge.

The term "methine-dye" in the present specification means a dye having two methine carbon atoms, where these two carbon atoms are joined by a double bond, and where these doubly bonded carbon atoms are integral to the chromophoric atoms of the methine-dye. The methine-dye moieties of the present specification have the structure:

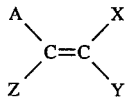

(IV)

where X, Y, Z, and A are substituents. These substituents X, Y, Z, and A do not join to form an aromatic ring system.

Element Layer Structures

A suitable Integral Layer Structure for elements of the present invention generally consists of a (1) dimensionally stable support of transparent or reflection material, (2) a receiver layer to which the diffusible methine-dye migrates under thermal activation, (3) a stripping layer to facilitate separation of the final diffusion-transfer image in the receiving layer from the silver and dye chemistry of the imaging layer(s), (4) imaging layers comprising one or more layers each independently containing silver compounds, dye-releasing compounds, reducing agents, and other standard addenda to achieve the requisite imaging, and (5) a protective overcoat layer or layers. Such an embodiment is illustrated below as Integral Layer Structure (1):

| Integral Layer Structure (1) |
|---|
| Protective Overcoat Layer |
| Imaging Layer(s) |
| Stripping Layer |
| Dye-Receiving Layer(s) |
| Support |

Stripping layers in such structures may be omitted. The imaging layer(s) and overcoat layer comprise a "donor" element. The support and dye-receiving layer comprises a "receiving" element.

Another suitable integral layer structure is illustrated below as Integral Layer Structure (2). A reflective opacifying layer is coated intermediate the dye-receiving layer(s) and the light sensitive imaging layer(s). Such an integral element has the provides the advantage of elimination of all waste, since there are no donor elements to be disposed of and there is no spent processing chemistry to sewer or discard. The Integral Layer Structure (2) below may also have a second, transparent dimensionally stable layer coated over the protective overcoat layer(s) or instead of the protective overcoat layer(s), to provide an encapsulated film unit.

| Integral Layer Structure (2) |
|---|
| Protective Overcoat Layer |
| Imaging Layer(s) |
| Opacifying Layer(s) |
| Dye-Receiving Layer(s) |
| Transparent Support |

A useful variation of Integral Layer Structure (2) is where the Protective Overcoat Layer and the Transparent Support are interchanged. Another suitable structure for elements of the present invention is the non-integral Laminate Layer Structure illustrated below, where separate donor and receiver elements are shown. The donor element comprises a support, one or more imaging layers, and optionally a

| Laminate Layer Structure |
|---|
| Receiver Support |
| Dye-Receiving Layer(s) |
| Protective Overcoat Layer |
| Diffusible-Dye Releasing (Imaging) Layer(s) |
| Donor Support |

protective overcoat layer. Such a donor element, subsequent to aqueous development and drying, is laminated to a suitable receiver element and heated to effect image dye transfer. Suitable receiver elements generally comprise a support and a dye-receiving layer or layers.

Support

The photographic elements can be coated on a variety of supports such as described in *Research Disclosure,* Item No. 308119, December 1989, pages 993–1018, Section XVII and the references described therein. Typical of useful paper supports are those which are partially acetylated or coated with baryta and/or a polyolefin, particularly a polymer of an α-olefin containing 2 to 10 carbon atoms, such as polyethylene, polypropylene, copolymers of ethylene and propylene and the like. Preferred paper-base supports also comprise auxiliary pigments such as titania (anitase, rhutile) to improve the reflectivity to visible light of said support. Suitable supports of the present invention can contain optical brighteners (see Research Disclosure, Item No. 308119, Section V). Suitable supports also include transparent film supports. Other suitable supports are described in U.S. Pat. No. 4,507,380, in column 32, lines 7–32.

Dye-Receiving Layers

The dye-receiving layer or layers to which the formed dye image is transferred according to the present invention may be coated on the photographic element between the imaging layer(s) and support as is illustrated in Integral Layer Structure (1), or may be in a separate dye-receiving element which is brought into contact with the photographic element during the dye transfer step, as is illustrated in Table 2. If present in a separate receiving element, the dye receiving layer may be coated or laminated to a support such as those described for the photographic element support above, or may be self-supporting. In a preferred embodiment of the invention, the dye-receiving layer is present between the support and the imaging layer(s) of an integral photographic element.

The dye receiving layer may comprise any material effective at receiving the heat transferable dye image. Examples of suitable receiver materials include polycarbonates, polyurethanes, polyesters, polyvinyl chlorides, poly(styrene-co-acrylonitrile)s, poly(caprolactone)s and mixtures thereof. The dye receiving layer may be present in any amount which is effective for the intended purpose. In general, good results have been obtained with amounts of from about 1 to about 10 g/m$^2$ when coated on a support. In a preferred embodiment of the invention, the dye receiving layer comprises a polycarbonate. The term "polycarbonate" as used herein means a polyester of carbonic acid and a glycol or a dihydric phenol. Examples of such glycols or dihydric phenols are p-xylene glycol, 2,2-bis(4-oxyphenyl-)propane, bis (4-oxyphenyl)methane, 1,1-bis(4-oxyphenyl) ethane, 1,1-bis(oxyphenyl)butane, 1,1-bisphenol-A polycarbonate having a number average molecular weight of at least about 25,000 is used. Examples of preferred polycarbonates include General Electric LEXAN" Polycarbonate Resin and Bayer AG MACROLON" 5700. Further, a thermal dye transfer overcoat polymer as described in U.S. Pat. No. 4,775,657 may also be used.

Other suitable image receiving layers and receiving elements are described in U.S. Pat. No. 4,507,380, at column 31, line 24 through column 32, line 6, in U.S. Pat. No. 4,847,188, at column 32, line 14 through column 33, line 51, in U.S. Pat. No. 4,847,188, at column 27, line 1 through column 28, line 16, and in U.S. Pat. No. 5,032,499, at column 76, line 1 through column 78, line 2.

Opacifying Layer

The opacifying layer is designed to be permeable to diffusible methine-dyes, allowing such dyes to pass from the image forming layer(s) to the receiving layer(s). The opacifying layer also provides sufficient diffuse light reflectance to serve as a backing for viewing the transferred dye image. The opacifying layer is typically composed of light scattering particulate material, such as colloidal titanium dioxide or highly scattering polymeric beads, and of binder. In preferred embodiments it also comprises thermal solvent. The composition of such opacifying layers is exemplified and described in U.S. Pat. Nos. 2,543,181, 3,415,646, 3,445,228, 3,647,437, 4,458,001, at column 29, lines 58–61, and 4,481, 277, at column 7, lines 4–16 and at column 11, lines 40 and 41, the disclosures of which are incorporated herein by reference. Preformed reflective layers are also described by Whitmore in Canadian Patent No. 674,082 and by Barr et al. in U.K. Patent No. 1,330,524. The composition of opacifying reflecting layers is further described in *Research Disclosure,* Item No. 15134, November 1976, page 41 and in Item No. 22534, January 1983, on pages 46–48 and 54. Colloidal titanium dioxide is typically coated at 5 to 30 g/m$^2$ and gelatin at 1 to 4 g/m$^2$. Thermal solvent is advantageously included at 0.5 to 4 g/m$^2$. Suitable polymeric beads are spherical beads that have a hollow core. The sudden change in index of refraction on going from an air core to a polymeric shell provides high scattering power with low density.

Stripping Layers

Stripping layers are included in preferred embodiments to facilitate the mechanical separation of receiver layers and mordant layers from donor layers and diffusible dye forming layers. Stripping layers are usually coated between a dye receiving layer and one or more diffusible dye-forming layers. Stripping layers may be formulated essentially with any material that is easily coatable, that will maintain dimensional inegrity for a sufficient length of time so that a suitable image may be transferred by dye diffusion there through with sufficiently adequate density and sharpness, and that will facilitate the separation of donor and receiver components of the photographic element under suitable stripping conditions. Said dimensional stability must be maintained during storage and during the development and dye forming process. Various stripping polymers and stripping agents may be used alone and in combination in order to achieve the desired strippability in particular processes with particular photographic elements. The desired strippability in a given process is that which results in clean separation between the image receiving layer(s) and the emulsion and diffusible dye forming layers adhering to the image receiving layer. Good results have in general been obtained with stripping agents coated at level of 3 mg/m$^2$ to about 500 mg/m$^2$. The particular amount to be employed will vary, of course, depending on the particular stripping agent employed and the particular photographic element used, and the particular process employed.

Perfluoronated stripping agents have been disclosed by Bishop et al. in U.S. Pat. No. 4,459,346, the disclosure of which is incorporated herein in its entirety by reference. In a preferred embodiment of our invention, the stripping layer comprises stripping agents of the following formula:

$$CF_3(CF_2)_n-SO_2-\overset{\overset{R_1}{|}}{N}-CH_2R_2$$

wherein $R_1$ is an alkyl or substituted alkyl group having from 1 to about 6 carbon atoms or an aryl or substituted aryl group having from about 6 to about 10 carbon atoms; $R_2$ is $$-\overset{\overset{O}{||}}{C}-O-(CH_2CH_2O)_x-R_3,$$

$$-\overset{\overset{O}{||}}{C}-O-(CH_2)_y-R_3,$$

or $$-CH_2-O-(CH_2CH_2O)_z-R_3;$$

$R_3$ is H or $R_1$; n is an integer of from about 4 to about 19; x and y each represents an integer from about 2 to about 50, and z each represents an integer of from 1 to about 50. In another preferred embodiment, $R_1$ is ethyl, $R_2$ is $$-\overset{\overset{O}{||}}{C}-O-(CH_2CH_2O)_x-H,$$

n is about 8, and x is about 25 to 50. In another preferred embodiment, $R_1$ is ethyl, $R_2$ is $$-\overset{\overset{O}{||}}{C}-O-(CH_2)_y-H,$$

n is about 8, and y is about 25 to 50. In another preferred embodiment, $R_1$ is ethyl, $R_2$ is $-CH_2O(CH_2CH_2O)_zH$, n is 8 and z is 1 to about 30.

If the process of this invention is used to produce a transparency element for use in high magnification projection, it is desirable to maintain sharpness and to minimize the thickness of the diffusion path. This minimization is achieved in part by using a stripping layer that does not swell appreciably and which is as thin as possible. These requirements are met by the perfluoronated stripping agents herein described. These agents provide clean stripping and do not materially alter the surface properties at the stripping interface. These perfluoronated stripping agents also provide for a stripping layer with weak dry adhesion. A strong dry adhesion makes separation of substantially dry elements difficult.

Preferred stripping agents useful in the process of this invention include the following compounds:

SA1

$$C_8F_{17}SO_2-\overset{\overset{CH_2CH_3}{|}}{N}-CH_2-\overset{\overset{O}{||}}{C}-O-(CH_2CH_2O)_{40}-H$$

(Fluorad ® FC-431 [3M Company])

SA2

$$C_8F_{17}SO_2-\overset{\overset{CH_2CH_3}{|}}{N}-CH_2-\overset{\overset{O}{||}}{C}-O-(CH_2)_{40}-H$$

(Fluorad ® FC-432 [3M Company])

SA3

$$C_8F_{17}SO_2-\overset{\overset{CH_2CH_3}{|}}{N}-(CH_2CH_2O)_{\overline{2-30}}-H$$

(Fluorad ® FC-170 [3M Company])

Imaging Layers

The silver halide emulsion employed in the elements of this invention can be either negative working or positive working. Example of suitable emulsions and their preparation are described in *Research Disclosure,* Item No. 308119, December 1989, Sections I and II and the publication cited therein. Examples of suitable vehicles for the emulsion layers and other layers of elements of this invention are described in *Research Disclosure,* Item No. 308119, Section IX and the publications cited therein.

Light sensitive silver halides of essentially any composition may be used to advantage in the elements of the present invention. These silver halide compositions may be prepared by any of the means now well known in the art.

The light-sensitive silver halide to be used in the present invention may include, for example, silver chloride, silver bromide, silver iodide, silver chlorobromide, silver chloroiodide and silver iodobromide. Such light-sensitive silver halides can be prepared by any of the methods commonly employed in the photographic art.

If desired, a silver halide emulsion having silver halide grains with a duplex structure (i.e., the halide composition of the grain surface differing from that of the interior) may be used and an example of such duplex grains is core/shell type silver halide grains. The shell of these grains may change in halide composition stepwise or gradually. The silver halide grains used may have a well-defined crystal habit as in cubes, spheres, octahedra, dodecahedra or tetradecahedra. Alternatively, they may not have any well-defined crystal shape. The silver halide grains in these light-sensitive emulsions may be coarse or fine; preferred grain sizes are on the order of 0.005 mm to 1.5 mm in diameter, With the range of from about 0.01 to about 0.5 mm being more preferred.

According to another method for preparing light-sensitive silver halides, a light-sensitive silver salt forming component may be used in the presence of organic silver salts (to be described below) so as to form light-sensitive silver halides in part of the organic silver salts.

These light-sensitive silver halides and light-sensitive silver salt forming component may be used in combination in a variety of methods, and the amount used in one photographic layer preferably ranges from 0.001 to 50 g, preferably 0.1–10 g, per square meter of base support.

The light-sensitive silver halide emulsions illustrated above may be chemically sensitized by any of the methods commonly employed in the photographic art. The light-sensitive silver halide emulsions to be used in the present invention may be spectrally sensitized-with known spectral sensitizers in order to provide sensitivity to the blue, green, red, or near-infrared region.

Typical examples of the spectral sensitizers that can be used in the present invention include cyanine dyes, merocyanine dyes, complex (tri- or tetra-nuclear) cyanine dyes, styryl dyes, hemicyanine dyes and oxonol dyes. These sensitizers are incorporated in amounts ranging from $1\times10^{-4}$ to 1 mole, preferably from $1\times10^{-4}$ to $1\times10^{-1}$ mole, per mole of the light-sensitive silver halide or silver halide forming component. The sensitizers may be added at any stage of the preparation of silver halide 5 emulsions; they may be added during the formation of silver halide grains, during the removal of soluble salts, before the start of chemical sensitization, during chemical sensitization or after completion of the chemical sensitization.

The selection of silver halide compositions, their precipitation, chemical sensitization, spectral sensitization, and coating in heat developable elements are disclosed in U.S. Pat. No. 4,507,380, at column 28, lines 37–58 and at column 30, lines 36–50, in U.S. Pat. No. 4,584,267, at column 25, line 42 through column 27, line 27, in U.S. Pat. No. 4,847,188, beginning at column 20, line 35, and in U.S. Pat. No. 5,032,499, at column 29, line 9 through column 30, line 8, the disclosures of which are incorporated herein by reference.

A variety of organic silver salts may be employed in the heat-processible photographic material of the present invention in order to increase its sensitivity or improve its developability.

Illustrating organic silver salts that may be employed in the heat-processible photographic material of the present invention include: silver salts of long-chain aliphatic carboxylic acids and silver salts of carboxylic acids having a hetero ring, such as silver behenate and silver a-(1-phenyltetrazolethio) acetate (see U.S. Pat. Nos. 3,330,633, 3,794,496 and 4,105,451); and silver salts of an imino group as described in U.S. Pat. No. 4,123,274.

Among the organic silver salts listed above, silver salts of an imino group are preferred. Particularly preferred are silver salts of benzotriazole derivatives such as 5-methylbenzotriazole or derivatives thereof, sulfobenzotriazole or derivatives thereof and N-alkylsulfamoylbenzotriazole or derivatives thereof.

These organic silver salts may be used either singly or as admixtures in the present invention. Silver salts prepared in suitable binders may be immediately used without being isolated. Alternatively, isolated silver salts may be dispersed in binders by suitable means before they are used. The organic silver salts are preferably used in amounts ranging from 0.01 to 500 moles, more preferably from 0.1 to 100 moles, most preferably from 0.3 to 30 moles, per mole of the light-sensitive silver halide.

Additional examples, methods of dispersing, and methods of coating organic silver salts in heat developable elements are disclosed in U.S. Pat. No. 4,507,380, at column 28, line 59 through column 30, line 2 and at column 30, lines 36–50, in U.S. Pat. No. 4,584,267, at column 27, line 28 through column 30, line 16, and in U.S. Pat. No. 5,032,499, at column 30, line 9 through column 31, line 37, the disclosures of which are incorporated herein by reference.

The reducing agent for use in the heat-processible photographic material of the present invention (the term "reducing agent" as used herein shall include precursors of the reducing agent) may be selected from among those which are commonly employed in the field of heat-processible photographic materials.

Reducing agents that can be used in the present invention include: p-phenylene-diamine-based or p-aminophenolic developing agents, phosphoroamidophenolic developing agents, sulfonamidoaniline-based developing agents, hydrazone-based color developing agents, and precursors of these developing agents, such as those described in U.S. Pat. Nos. 3,531,286, 3,761,270, and 3,764,328. Also useful are phenols, sulfonamidophenols, polyhydroxybenzenes, naphthols, hydroxybi-naphthyls, methylenebisnaphthols, methylenebisphenols, ascorbic acids, 3-pyrazo-lidones, pyrazolones, etc. The reducing agents may be used either on their own or as admixtures. The amount in which the reducing agents are used in the heat-processible photographic material of the present invention depend upon many factors such as the type of light-sensitive silver halide used, the type of organic acid silver salt, and the type of other additives used. Usually, the reducing agents are used in amounts ranging from 0.01 to 1,500 moles per mole of light-sensitive silver halide, with the range of 0.1–200 moles being preferred.

Other useful examples of reducing agents and their preparation and coating in heat developable elements are disclosed in U.S. Pat. No. 4,507,380, at column 32, line 33 through column 33, line 25, in U.S. Pat. No. 4,584,267, at column 5, line 31 through column 7, line 30, in U.S. Pat. No. 5,032,499, at column 53, line 18 through column 58, line 9, and are incorporated herein by reference.

The heat-processible photographic material of the present invention is suitable for processing by transfer photography using an image-receiving member. In the practice of the present invention, a variety of heat solvents are preferably incorporated in the heat-processible photographic material and/or the image-receiving member.

Particularly useful heat solvents are urea derivatives (e.g., dimethylurea, diethylurea and phenylurea), amide derivatives (e.g., acetamide, benzamide and p-toluamide), sulfonamide derivatives (e.g., benzenesulfonamide and a-toluenesulfonamide), and polyhydric alcohols (e.g., 1,6-hexanediol, 1,2-cyclohexanediol and pentaerythritol, and polyethylene glycol. Water-insoluble solid heat solvents may be used with particular advantage.

Heat solvents may be incorporated in various layers such as light-sensitive silver halide emulsion layers, intermediate layers, protective layers, and image-receiving layers in an image-receiving member so that the results desired in respective cases can be obtained.

Heat solvents are usually incorporated in amounts ranging from 10 to 500 wt % preferably from 30 to 200 wt %, of the binder. Other useful heat solvents and methods for dispersing them and coating in heat developable elements are disclosed in U.S. Pat. No. 4,507,380, at column 34, lines 12–46, in U.S. Pat. No. 4,847,188, at column 23, lines 32–68, and in U.S. Pat. No. 5,032,499, at column 61, line 1 through column 67, line 2, and are incorporated herein by reference.

Useful incorporated base precursors include compounds that undergo decarboxylation upon heating to release a basic substance (e.g., guanidium trichloroacetate) and compounds that are decomposed by reactions such as intramolecular nucleophilic substitution reaction to release amines. Other additives that are used as required in heat-processible photographic materials may also be incorporated in the heat-processible photographic material of the present invention. Illustrative additives include antihalation dyes, brighteners, hardeners, antistats, plasticizers, extenders, matting agents, surface-active agents and antifading agents. These additives may be incorporated not only into light-sensitive layers but also into non-light-sensitive layers such as intermediate layers, protective layers and backing layers. Other suitable base precursors and base releasers are disclosed in U.S. Pat. No. 4,507,380, at column 33, lines 26–55, the disclosure of which is incorporated herein by reference.

A variety of other dye-forming and dye releasing compounds may be incorporated into the elements of the present invention. Suitable dye-forming and dye-releasing compounds, their synthesis, and their preparation for coating in heat developable elements are disclosed in U.S. Pat. No. 4,507,380, at column 3, line 49 through column 28, line 36, in U.S. Pat. No. 4,584,267, at column 7, line 31 through column 25, line 41, in U.S. Pat. No. 4,847,188, at column 2, line 30 through column 18, line 59, and in U.S. Pat. No. 5,032,499, at column 31, line 38 through column 53, line 17, the disclosures of which are incorporated herein by reference.

Binders that can usefully be employed in the heat-processible photographic material of the present invention include: synthetic high-molecular compounds such as polyvinylbutyral, polyvinyl acetate, ethyl cellulose, polymethyl methacrylate, cellulose acetate butyrate, polyvinyl alcohol and polyvinylpyrrolidone; synthetic or natural high-molecular compounds such as gelatin, gelatin derivatives (e.g., phthalated gelatin), cellulose derivatives, proteins, starches, and gum arabic. These high-molecular compounds may be used either singly or in combination. It is particularly preferred to employ gelatin or its derivatives in combination with synthetic hydrophilic polymers such as polyvinylpyrrolidone and polyvinyl alcohol. A more preferred binder is a mixture of gelatin and polyvinylpyrrolidone.

The binders are generally used in amounts ranging from 0.05 to 50 g, preferably from 0.2 to 20 g, per square meter of the base support. The binders are preferably used in amounts of 0.1–10 g, more preferably 0.2–5 g, per gram of the dye-providing material. Other examples of useful binders are disclosed in U.S. Pat. No. 4,507,380, at column 30, line 51 through column 31, line 23, in U.S. Pat. No. 4,584,267, at column 3, line 7 through column 5, line 30, in U.S. Pat. No. 4,847,188, at column 20, lines 10–34, in U.S. Pat. No. 5,032,499, at column 75, lines 13–68, and in U.S. Pat. No. 5,032,499, at column 58, lines 10–68, the disclosures of which are incorporated herein by reference.

Besides the components described above, the heat-processible photographic material of the present invention may incorporate various other additives such as development accelerators, antifoggants, stabilizers, etc. Such compounds and their use in heat developable elements are disclosed in U.S. Pat. No. 4,507,380, at column 34, line 58 through column 35, line 2, in U.S. Pat. No. 4,584,267, at column 30, line 71 through column 31, line 39, in U.S. Pat. No. 4,847,188, at column 18, line 60 through column 20, line 9, in U.S. Pat. No. 4,847,188, at column 24, line 1 through column 25, line 33, and in U.S. Pat. No. 5,032,499, at column 3, line 52 through column 28, line 16 and at column 67, line 3 through column 75, line 12, the disclosures of which are incorporated herein by reference.

Diffusible Methine-Dye Releasing Couplers

Diffusible methine-dye releasing compounds of any type may be utilized, so long as the released diffusible methine-dye is diffusible at elevated temperature in a hydrophilic colloid such as gelatin and other hydrophilic colloids when said colloids are nominally dry (contain less than 50% by weight water). Preferred are compounds according to formula I $$Cp—L—M \qquad (I)$$

wherein Cp is a coupler radical, L is a divalent linking group or a bond, and M is a methine-dye radical exhibiting selective absorption in the visible spectrum.

COUPLING RADICALS

Cp may represent a coupler moiety, capable of forming a cyan dye by coupling with an aromatic primary amine developing agent. Couplers which form cyan dyes upon reaction with oxidized color developing agents are described in such representative patents as U.S. Pat. Nos. 2,367,531, 2,423,730, 2,474,293, 2,772,162, 2,801,171, 2,895,826, 3,002,836, 3,034,892, 3,041,236, 3,419,390, 3,476,565, 3,779,763, 3,996,252, 4,124,396, 4,248,962, 4,254,212, 4,296,200, 4,333,999, 4,443,536, 4,457,559, 4,500,635, 4,526,864, and 4,874,689 and in European Patent Application No. 0 283 938 A1, the disclosures of which are incorporated by reference. Preferred coupler moieties Cp which form cyan dyes upon reaction with oxidized color developing agents are disclosed on page 11, line 27 through page 14, line 20 of copending, commonly assigned U.S. application Ser. No. 07/993,580 of Texter et al., filed Dec. 21, 1992, and are incorporated herein by reference.

Cp may represent a coupler moiety, capable of forming a magenta dye by coupling with an aromatic primary amine developing agent. Couplers which form magenta dyes upon reaction with oxidized color developing agents are described in such representative patents and publications as U.S. Pat. Nos. 1,969,479, 2,311,082, 2,343,703, 2,369,489, 2,600,788, 2,908,573, 3,061,432, 3,062,653, 3,152,896, 3,519,429, 3,615,506, 3,725,067, 4,120,723, 4,500,630, 4,522,916, 4,540,654, 4,581,326, and 4,874,689, and European Patent Publication Nos. 0 170 164, 0 177 765, 0 283 938 A1, and 0 316 955 A3, the disclosures of which are incorporated by reference. Preferred magenta couplers include pyrazolones, pyrazolotriazole, and pyrazolobenzimidazole compounds which can form heat transferable dyes upon reaction with oxidized color developing agent. Preferred coupler moieties Cp which form magenta dyes upon reaction with oxidized color developing agents are disclosed on page 14, line 31 through page 16, line 29 of copending, commonly assigned U.S. application Ser. No. 07/993,580 of Texter et al., filed Dec. 21, 1992, and are incorporated herein by reference.

Cp may represent a coupler moiety, capable of forming a yellow dye by coupling with an aromatic primary amine developing agent. Couplers which form yellow dyes upon reaction with oxidized color developing agent are described in such representative U.S. Pat. Nos. as 2,298,443, 2,875,057, 2,407,210, 3,265,506, 3,384,657, 3,408,194, 3,415,652, 3,447,928, 3,542,840, 4,046,575, 3,894,875, 4,095,983, 4,182,630, 4,203,768, 4,221,860, 4,326,024, 4,401,752, 4,443,536, 4,529,691, 4,587,205, 4,587,207 and 4,617,256, and in European Patent Applications 0 259 864 A2, 0 283 938 A1 , and 0 316 955 A3, the disclosures of which are incorporated by reference. Preferred yellow dye image forming couplers are acylacetamides, such as benzoylacetanilides and pivalylacetanilides, which can form heat transferable dyes upon reaction with oxidized color developing agent. Preferred coupler moieties Cp which form yellow dyes upon reaction with oxidized color developing agents are disclosed on page 17, lines 2–26 of copending, commonly assigned U.S. application Ser. No. 07/993,580 of Texter et al., filed Dec. 21, 1992, and are incorporated herein by reference.

Cp may represent a coupler moiety, capable of forming a colorless product by coupling with an aromatic primary amine developing agent. Couplers which form colorless products upon reaction with oxidized color developing agent are described in such representative U.S. Pat. Nos. as 3,632,345, 3,928,041, 3,958,993, and 3,961,959, and in United Kingdom Patent No. 861,138, the disclosures of which are incorporated herein by reference. Preferred colorless product forming couplers are cyclic carbonyl containing compounds and have the coupling-off group attached to the carbon atom in the position with respect to the carbonyl group. Preferred coupler moieties Cp which form colorless products upon reaction with oxidized color developing agents are disclosed on page 18, lines 3–10 of copending, commonly assigned U.S. application Ser. No. 07/993,580 of Texter et al., filed Dec. 21, 1992, and are incorporated herein by reference.

Cp may represent a coupler moiety, capable of forming a black dye or a brown dye by coupling with an aromatic primary amine developing agent. Couplers which form black and brown dyes upon reaction with oxidized color developing agent are described in such representative U.S. Pat. Nos. as 1,939,231, 2,181,944, and 2,333,106, and 4,126,461, and German OLS Nos. 2,644,194 and 2,650,764, which are incorporated herein by reference. Preferred black and brown dye forming couplers are resorcinols or m-aminophenols and have the coupling-off group attached in the para-position with respect to the hydroxyl group. Preferred coupler moieties Cp which form black or brown dyes upon reaction with oxidized color developing agents are disclosed on page 18, line 18 through page 19, line 7 of copending, commonly assigned U.S. application Ser. No. 07/993,580 of Texter et al., filed Dec. 21, 1992, and are incorporated herein by reference.

Preferred embodiments of the elements of the present invention contain Cp—L—M compounds according to structure (I) that have aqueous solubilizing groups on the Cp radical. Preferred examples of such solubilizing groups include carboxy and sulfo groups giving carboxcylic acid and sulfonic acid functionality. Such groups serve to immobilize Cp—L—M compounds against thermal diffusion, and thus prevent color contamination in the dye-receiving layer by non-imagewise transfer of Cp—L—M compounds. The Cp—L—M compounds are generally colored, because the linking does not generally serve to render the methine-dye radicals M completely colorless.

Any of the foregoing coupler radicals may be ballasted by attachment to a polymer at some position other than the coupling position of said radicals.

LINKING GROUPS

The linking group may be any divalent group or a bond that attaches to the coupling position of Cp and to the M moiety such that the coupling-off group, comprising the linking group L and the methine-dye M, —L—M, is released from the coupler upon reaction of oxidized developer with the coupling moiety and such that the M moiety is subsequently released from the coupling-off group. Linking groups suitable for the present invention have been described in U.S. Pat. Nos. 4,248,962, 4,409,323, and 4,840,884, the disclosures of which are incorporated herein by reference. The group L can contain moieties and substituents which will permit control of one or more of the rate of reaction of Cp with oxidized color developing agent, the rate of diffusion of the coupling off group, and the rate of release of Dye.

The linking group L may be only a divalent bond, so that —L—M is actually well represented by —M, where the M moiety is attached directly to the Cp radical. In this case, the structure Cp—M is a special case of structure (I), Cp—L—M.

Suitable linking groups include the following:

L-1

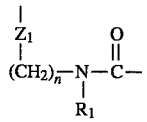

where n is 1–4, n is preferably 2 or 3;

L-2

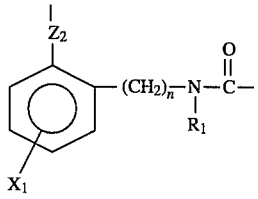

L-3

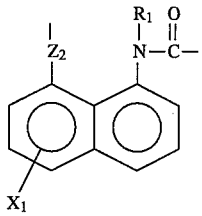

where n is 0 or 1;

L-4

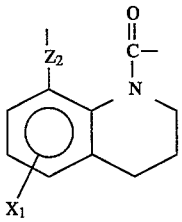

L-5

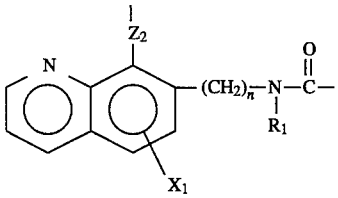

where n is 0 or 1;

L-6

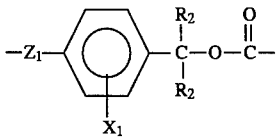

L-7

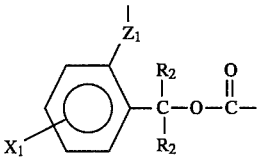

L-8

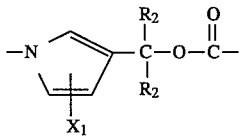

L-9

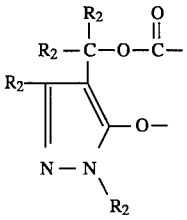

L-10

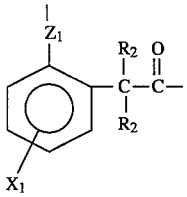

L-11

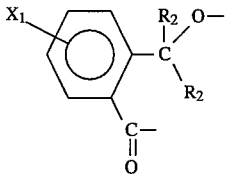

-continued

L-12

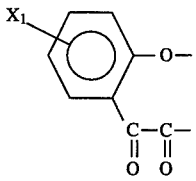

L-13

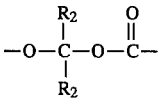

L-14

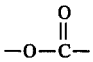

wherein $Z_1$ is

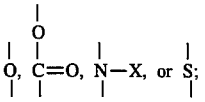

where X is a substituent;

$Z_2$ is

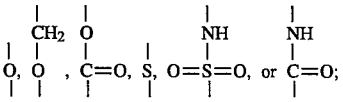

$R_1$ is hydrogen, alkyl of 1 to 20 carbon atoms, preferably lower alkyl of 1 to 4 carbon atoms, or aryl of to 30 carbon atoms, preferably aryl of 6 to 10 carbon atoms;

each $R_2$ independently is hydrogen, alkyl of 1 to 25 carbon atoms, preferably lower alkyl of 1 to 4 carbon atoms, cycloalkyl, substituted cycloalkyl, or aryl of 6 to carbon atoms, preferably aryl of 6 to 10 carbon atoms;

$X_1$ is hydrogen, cyano, fluoro, chloro, bromo, iodo, nitro, alkyl of 1 to 20 carbon atoms, aryloxy, alkoxycarbonyl, carboxy, hydroxy, sulfonyl, acyl, alkoxy, sulfo, —$OR_2$, —$COOR_2$, —$CONHR_2$, —$NHCOR_2$, —$NHSO_2R_2$, $SO_2NHR_2$, or —$SO_2R_2$.

The following are suitable examples of these preferred linking groups:

LK-1

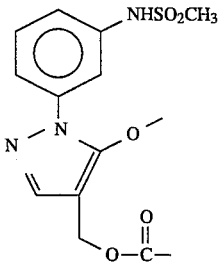

-continued

LK-2

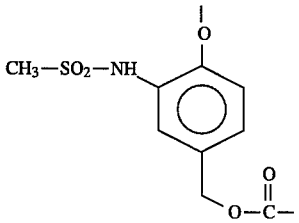

LK-3

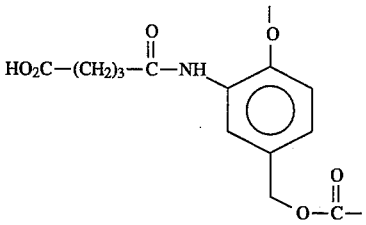

LK-4

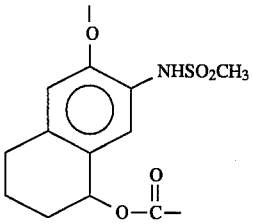

LK-5

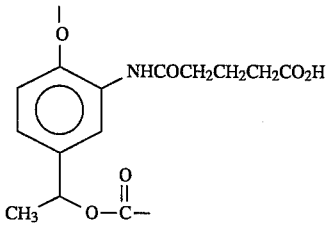

LK-6

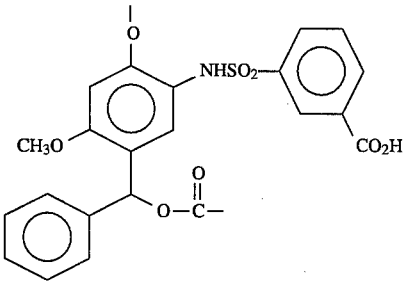

LK-7

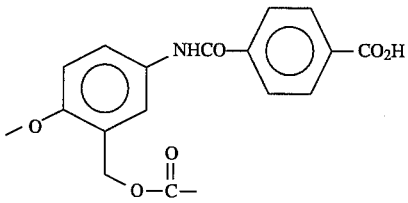

-continued

LK-8

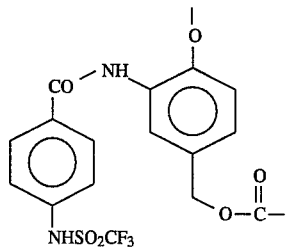

Particularly preferred linking groups are those that have ionizable acid functionality not integral to the linking of dye radical to coupler. Such functionality includes carboxy and sulfo groups, and metal salts of such groups. This kind of functionality serves to immobilize the linking group, as well as the dye releasing compound Cp—L—M, against thermal diffusion through hydrophilic binder. Such an impediment to unwanted diffusion reduces non-imagewise stain in the receiver layer that can be attributed to diffusion of the dye releasing compound Cp—L—M.

DYE RADICALS

The methine-dye moiety M in coupler structure (II) may be any diffusible methine-dye or diffusible methine-dye precursor, including leuco methine-dye or shifted methine-dye.

Suitable examples of methine-dye radicals are given by structure ( II ):

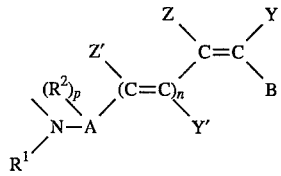

(II)

wherein $R^1$ is hydrogen or a substituted or unsubstituted alkyl or aryl (including heteroaryl) group;

A is a substituted or unsubstituted aryl (including heteroaryl) ring;

each $R^2$ is independently a substituted or unsubstituted alkyl group which may form a ring with Z or Z when n =0;

p is an integer from 0 to 3;

each Z, Z', and Y' is independently hydrogen or a substituent;

Y is an electron withdrawing group;

n is 0, 1, or 2; and

B is a heterocycle having the formula (III):

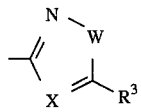

(III)

wherein:

X is O, S, or $N(R^5)$ where $R^5$ is hydrogen or alkyl;

W is N or $C(R^4)$ where $R^4$ is hydrogen or a substituent;

$R^3$ is a substituent linked to the heterocycle by a carbon or nitrogen atom of the substituent;

provided that $R^3$ and $R^4$ may be linked to form a ring. In preferred embodiments, when Z is hydrogen and X is oxygen, neither $R^3$ nor $R^4$ nor a ring formed by them contains a substituent having a Hammett's sigma(para) value of 0.23 or more. Such a limitation imparts improved stability of the chromophore against nucleophilic attack.

Methine-dye radicals having a bond attached to a nitrogen atom as the point of attachment to the linking group L are preferred over radicals having oxygen as the point of attachment, because the resulting NH group is less polar and will tend to offer less of an impediment to diffusion transfer through hydrophilic binder than will the OH group.

In a preferred embodiment of the elements of the present invention having methine-dye releasing couplers according to structure (I), Cp—L—M, methine-dye radicals having a bond attached to an oxygen as the point of attachment to the linking group L are absent. Elements devoid of such oxygen attachments avoid the consequences of hydroxy group interactions between the diffusing methine-dye and polar functional groups in the hydrophilic binder.

The methine-dye radicals of the elements of the present invention may or may no be attached to the linking group L or to the coupler radical Cp of general structure (I) through a chromophoric atom, such as nitrogen or oxygen. Attachment through a chromophoric atom often provides beneficial hue shifting, so that the final hue is not realized until after the dye radical separates from the coupler and linking group. Attachment through a non-chromophoric atom often imparts improved storage stability, and such attachments are preferred when hue shifting is not a significant concern and it is desired to design the linking and release chemistry without significantly affecting the dye hue before or after release.

Methods for synthesizing methine-dyes are disclosed in U.S. Pat. Nos. 2,798,090, 2,889,335, 3,013,013, 3,247,211, 3,661,899, 3,879,434, 3,917,604, 4,006,178, 4,180,663, and 4,281,115, the disclosures of which are incorporated herein in their entirety for all they disclose about methine-dyes. General schemes for synthesizing methine-dyes are described by P. Gregory (pp. 36–40) and by L. Shuttleworth and M. A. Weaver (pp. 119–128) in *The Chemistry and Application of Dyes,* edited by D. R. Waring and G. Hallas, and published by Plenum Press of New York, ©1990.

Examples of methine-dye suitable for the elements of the present invention include the following; the asterisk denotes the point of attachment of the methine-dye to the divalent linking group L:

DC-1

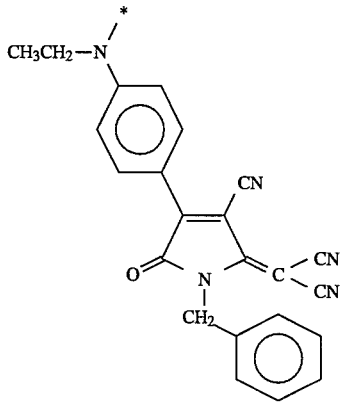

DC-2

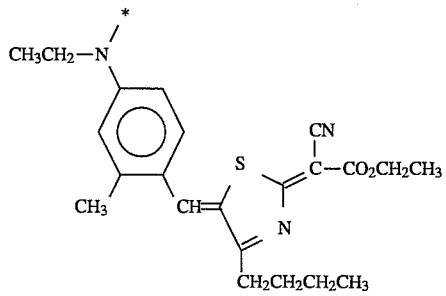

-continued
DC-3
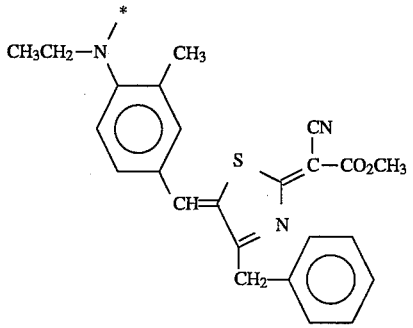
DC-4
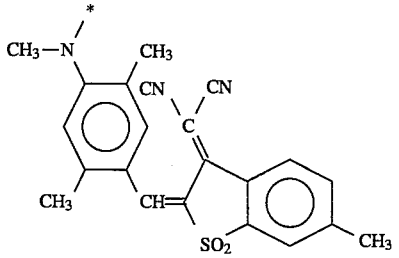
DC-5
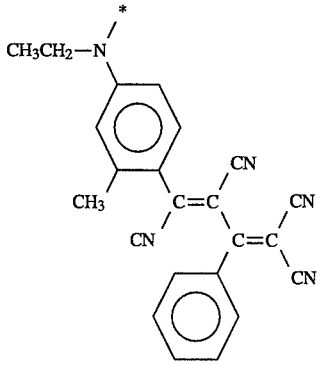
DC-6
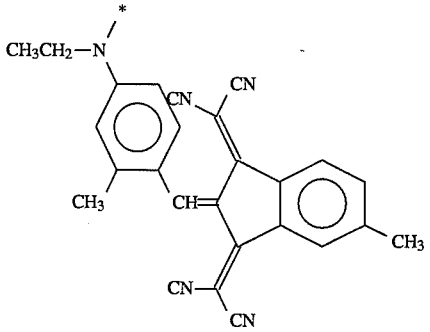
DC-7
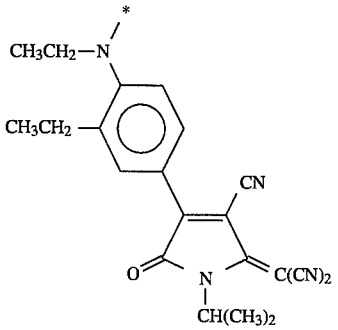

-continued
DC-8
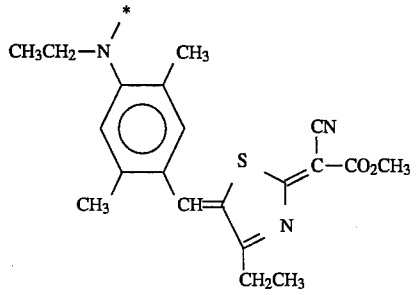
DC-9
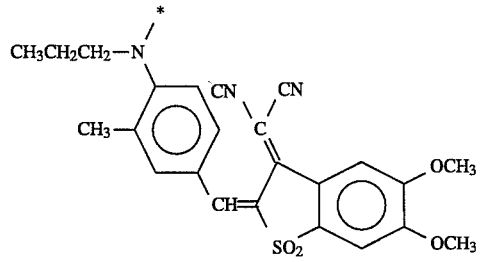
DM-1
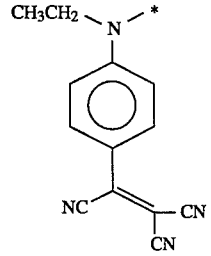
DM-2
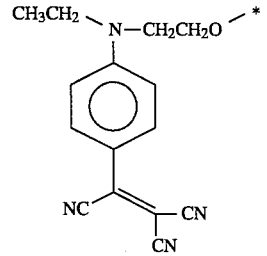
DM-3
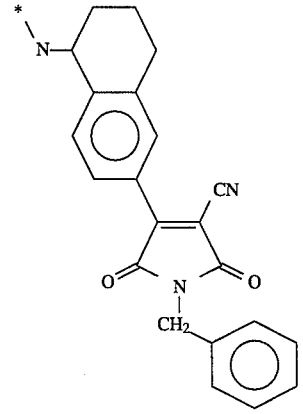

-continued
DM-4
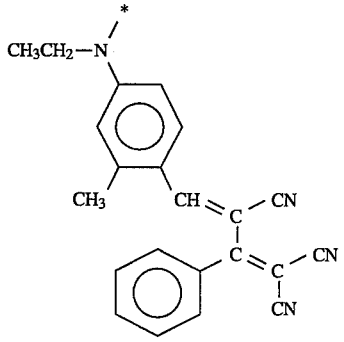
DM-5
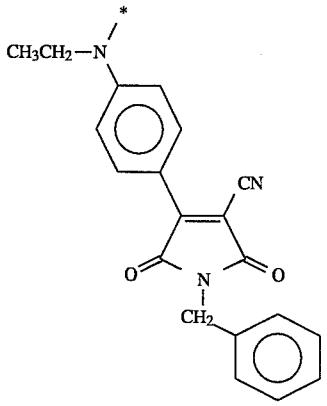
DM-6
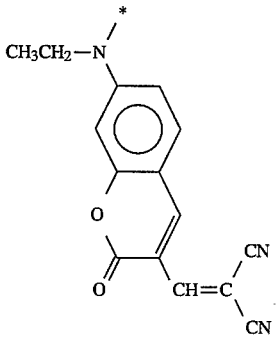
DM-7
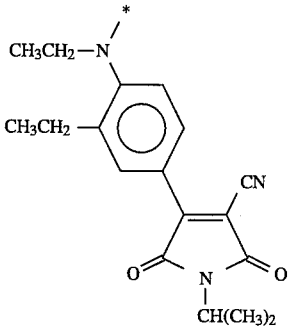

-continued
DM-8
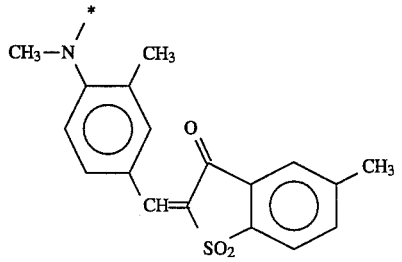
DM-9
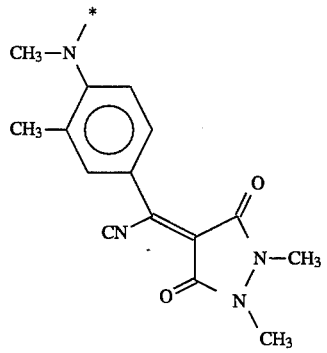
DM-10
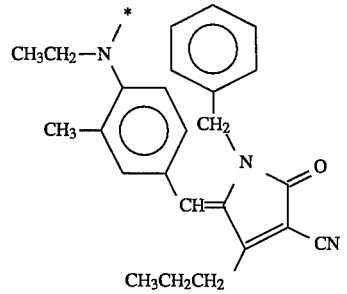
DM-11
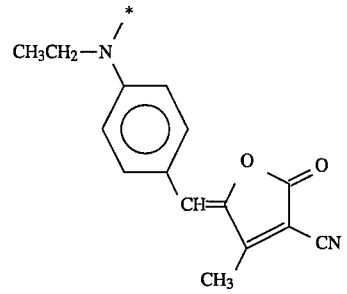
DM-12
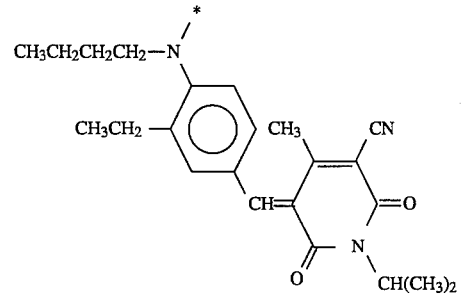

-continued
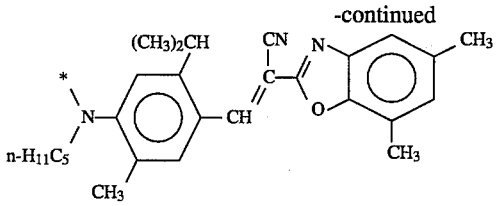
DY-1
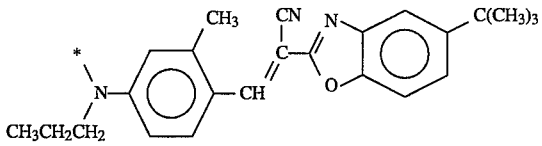
DY-2
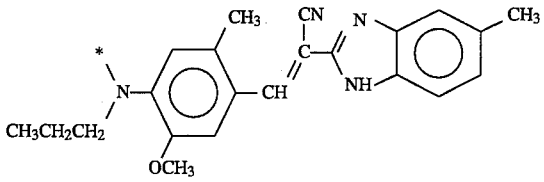
DY-3
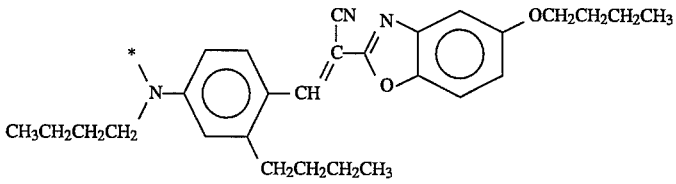
DY-4
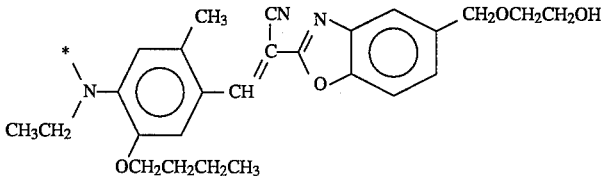
DY-5
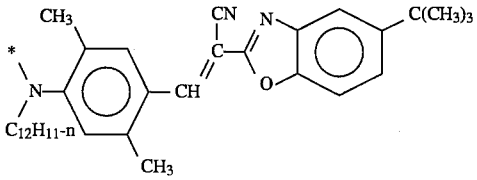
DY-6
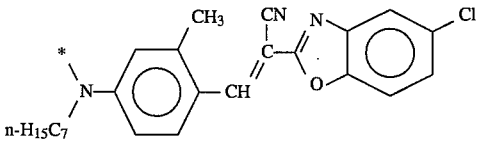
DY-7
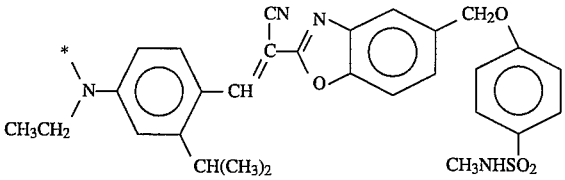
DY-8

-continued
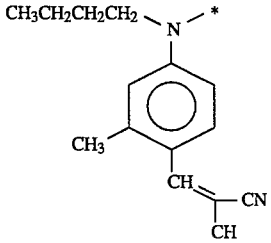
DY-9
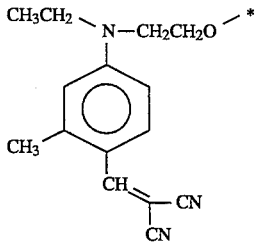
DY-10
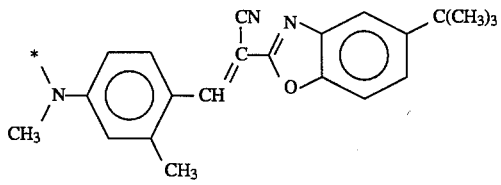
DY-11
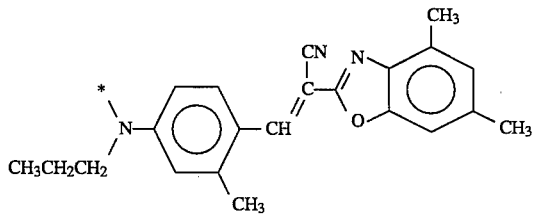
DY-12
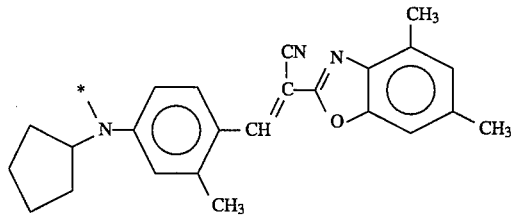
DY-13
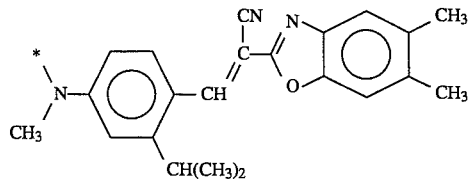
DY-14
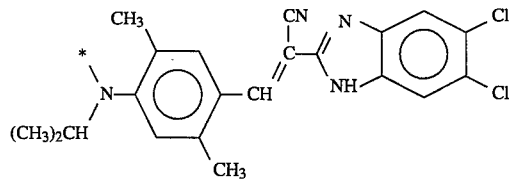
DY-15
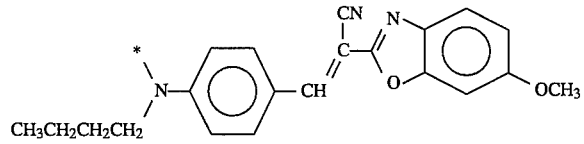
DY-16

-continued

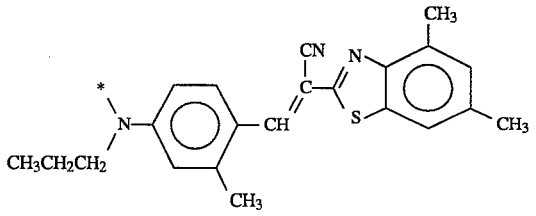

DY-17

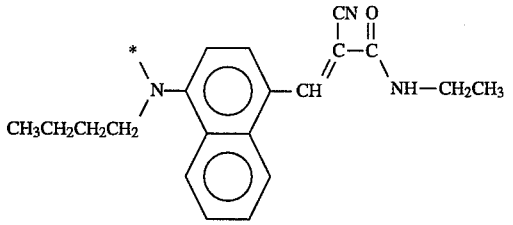

DY-18

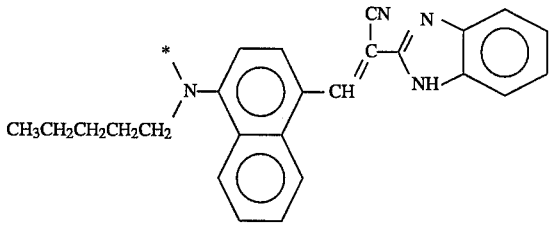

DY-19

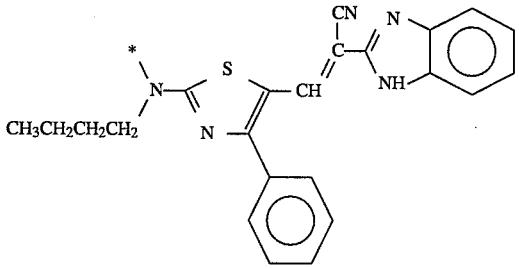

DY-20

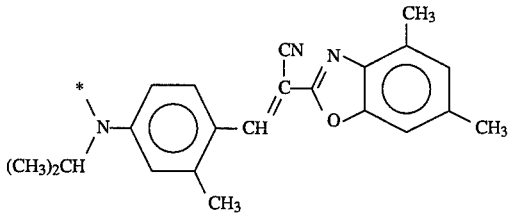

DY-21

Example couplers of the present invention are exemplified by compounds I-1 through I-64 in copending, commonly assigned, simultaneously filed (Kodak Attorney Docket No. 67,332) U.S. application Ser. No. 08/250,145, Photographic Element Containing A High Dye-Yield Coupler with a Methine Dye Chromophore, of Mooberry et al., the disclosure of which is incorporated herein by reference for all it discloses about methine-dye releasing couplers and photographic elements.

Thermal Solvents

Thermal solvents may be added to any layer(s) of the photographic element, including interlayers, imaging layers, and receiving layer(s), in order to facilitate transfer of dye to said receiving layer(s). Suitable thermal solvents have the structure (V),

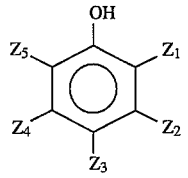

(V)

wherein (a) $Z_1$, $Z_2$, $Z_3$, $Z_4$, and $Z_5$ are substituents, the Hammet sigma parameters of $Z_2$, $Z_3$, and $Z_4$ sum to give a total, $\Sigma$, of at least −0.28 and less than 1.53;

(b) the calculated logP for I is greater than 3 and less than 10.

Examples of thermal solvents include 3-hydroxy benzoates, 4-hydroxy benzoates, 3-hydroxy benzamides, 4-hydroxy benzamides, 3-hydroxyphenyl acetamides, and 4-hydroxyphenyl acetamides. In a given layer, said thermal solvent is generally added at 1 to 300% by weight of binder in said layer. Preferably, said thermal solvent is generally added at 50 to 120% by weight of binder in said layer.

Preferred examples of said thermal solvents include aryl and alkyl esters of 3-hydroxy benzoic acid and of 4-hydroxy benzoic acid. Examples of such thermal solvents are listed on pages 27 and 28 of commonly assigned U.S. application Ser. No. 07/993,580 of Texter et al., filed Dec. 21, 1992 as Dye Releasing Couplers for Heat Image Separation Systems, now U.S. Pat. No. 5,356,750 beginning on line 18 of page 27 therein, and are incorporated herein by reference.

Exposure

Photographic elements can be exposed to actinic radiation, typically in the visible region of the spectrum, to form a latent image as described in Research Disclosure, Item No. 308119, December 1989, Section XVIII.

Heat Development

Heating times of from about 10 seconds to 30 minutes at temperatures of from about 50° to 200° C. (more preferably 75° to 160° C., and most preferably 80° to 120° C.) are preferably used to activate the heat development process. This aspect makes it possible to use receiver polymers that have a relatively high glass transition temperature (Tg) (e.g., greater than 100° C.) and still effect good transfer, while minimizing back transfer of dye (diffusion of dye out of the receiver onto or into a contact material).

Diffusion Dye Transfer

Additonal heating of from about 10 seconds to 30 minutes at temperatures of from about 50° to 200° C. (more preferably 75° to 160° C., and most preferably 80° to 120° C.) are preferably used to activate the thermal transfer process, when heat development and dye-diffusion transfer to a separate receiver member are done as separate steps. This aspect makes it possible to use receiver polymers that have a relatively high glass transition temperature (Tg) (e.g., greater than 100° C.) and still effect good transfer, while minimizing back transfer of dye (diffusion of dye out of the receiver onto or into a contact material).

Heat development and dye-diffusion transfer may be executed as separate steps, even for integral elements of the present invention. It is sometimes preferred to use a short-time high-temperature heat development step, and a lower-temperature longer-time dye-diffusion transfer step. These operations, temperature ranges, and sequences may be varied to suit the properties of the silver development, the diffusibility of the released dyes, and the thermal stability of the respective elements and chemical components therein.

While essentially any heat source which provides sufficient heat to effect heat development and/or transfer of the developed dye image from the emulsion or imaging layer to the dye receiving layer may be used, in a preferred embodiment dye transfer is effected by running the developed photographic element with the dye receiving layer (as an integral layer in the photographic element or as part of a separate dye receiving element) through a heated roller nip. Thermal activation transport speeds of 0.1 to 50 cm/sec are preferred to effect transfer at nip pressures of from about 500 Pa to 1,000 kPa and nip temperatures of from about 75° to 190° C. Particularly useful methods of heating and stripping are described by Texter et al. in U.S. Pat. No. 5,164,280 and by Lynch and Texter in U.S. Pat. No. 5,294,514, the disclosures of which are incorporated herein in their entireties. Heat development and dye-diffusion transfer processes and apparatus are disclosed in U.S. Pat. Nos. 4,507,380, 4,536,467, 4,584,267, 4,770,989, 4,847,188 5,001,033, 5,004,667, and 5,032,499, and are incorporated herein by reference.

The advantages of the present invention will become more apparent by reading the following examples. The scope of the present invention is by no means limited by these examples, however.

Examples

Synthesis Example

Preparation of Invention Methine-Dye Releasing Coupler Y-1

Y-1

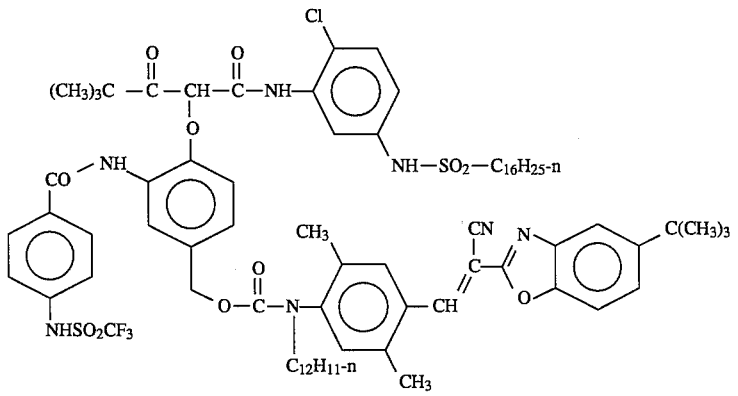

The overall scheme for the synthesis of dye-releasing coupler Y-1 is illustrated in Scheme 1. The linking group intermediate i-1 is prepared in four steps. Commercially available methyl-p-amino benzoate (78.6 g, 0.52 mole) is dissolved in about 500 ml of methylene chloride containing 2,6-lutidine (56 g, 0.52 mole, 60.7 ml), cooled in an ice bath and treated with trifluoromethane sulfonic anhydride (146 g, 0.52 mole/l in 50 ml of methylene chloride) dropwise over 5 minutes. The reaction mixture is warmed to room temperature over 30 minutes before washing with excess 2N HCl. The organic phase is then washed four times with 250 ml portions of 1N $NaHCO_3$. The aqueous washes are acidified with 12N HCl to precipitate a creamy solid which is collected, washed with water, and air dried to yield 86 g of the trifluoromethyl-sulfonamide (methyl-p-trifluoromethylsulfonamido benzoate). This trifluoromethylsulfonamide (86 g, 0.3 mole) is added to a stirred solution of NaOH (55 g, 1.38 mole) in 660 ml of water. The mixture is stirred for about 15 minutes before minutes with good stirring to a solution of 3-amino-4-hydroxy benzyl alcohol (27.5 g, 0.198 mole) in 100 ml of pyridine cooled to 5° C. in a 3-neck round bottom flask fitted with mechanical stirrer. After 30 minutes at room tempera- Scheme 2

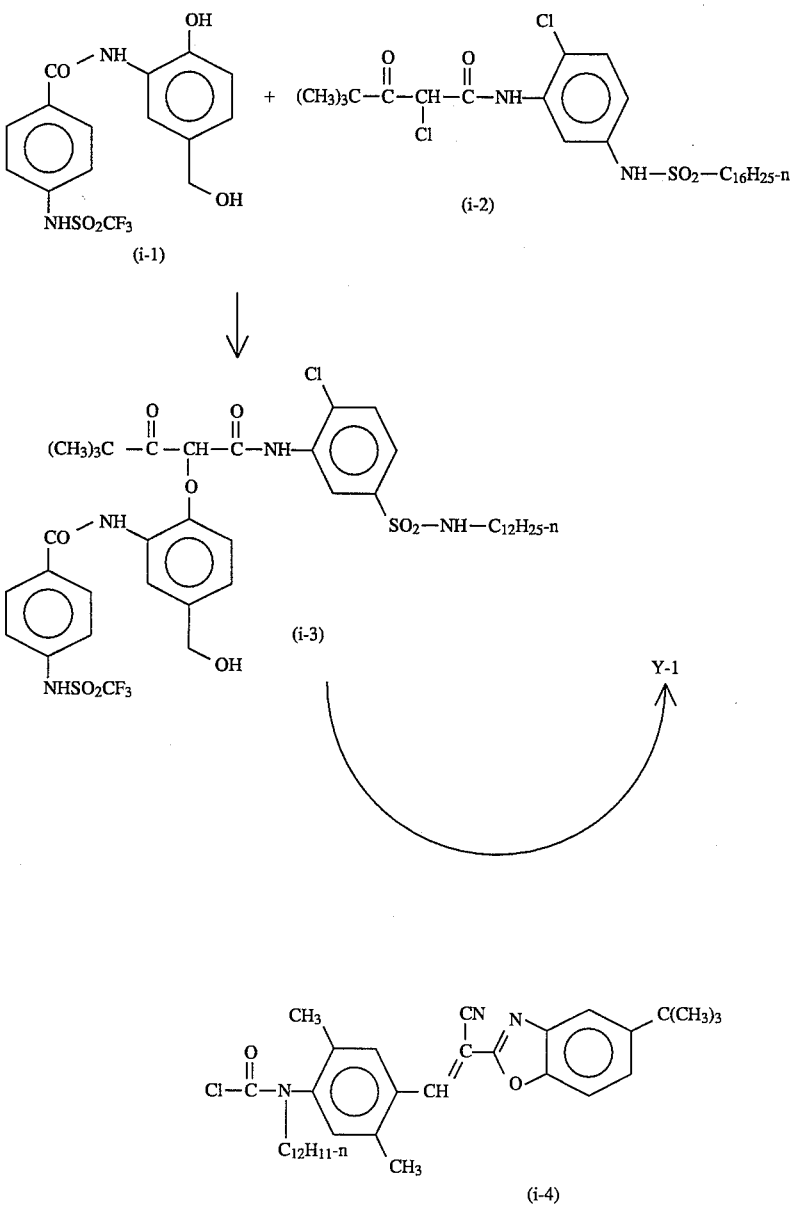

acidifying with excess 2N HCl to yield a precipitate that is collected, washed with water, and air dried to yield 72 g of the saponofied benzoic acid. This benzoic acid (74.9 g, 0.278 mole) is converted to acid chloride by stirring in a mixture of 350 ml ethyl acetate, 3 drops of DMF, and 53 g (0.417 mole) oxalyl chloride for 3 hours. Solvents are distilled off under vacuum and residual oxalyl chloride is chased three times with a mixture of 150 ml methylene chloride and 50 ml heptane. The crude oil is mixed with 25 ml of heptane and placed in a refrigerator overnight. The crystals that form are slurried in about 200 ml of heptane and air dried to yield 57.6 g of the acid chloride. This acid chloride (57.6 g, 0.198 mole, in 100 ml tetrahydrofuran) is added dropwise over ten ture the reaction mixture is diluted with 300 ml of ethyl acetate and washed with excess 2N HCl and water. The organic layer is dried over $MgSO_4$ and stripped to a crude oil that crystallized rapidly with addition of 200 ml heptane. The crystals are collected and air dried to yield 69 g of the linking group i-1.

This linking group i-1 is attached to coupler i-2 by combining 32 g (0.082 mole) of i-1 and 48.5 g (0.082 mole) of i-2 with 200 ml of DMF and treating with tetramethylguanidine (18.8 g, 0.164 mole). The reaction mixture is stirred for 2 hours and then diluted with ethyl acetate and washed with excess 1N HCl and water. The organic layer is dried over $MgSO_4$ and concentrated to an oil. The oil is dissolved in 2 parts of ethyl acetate and diluted with 8 parts heptane. The solvents are evaporated with stirring to yield brown crystals. These crystals are slurried in heptane, collected, and air dried to yield about 60 g of coupler i-3.

Scheme 2

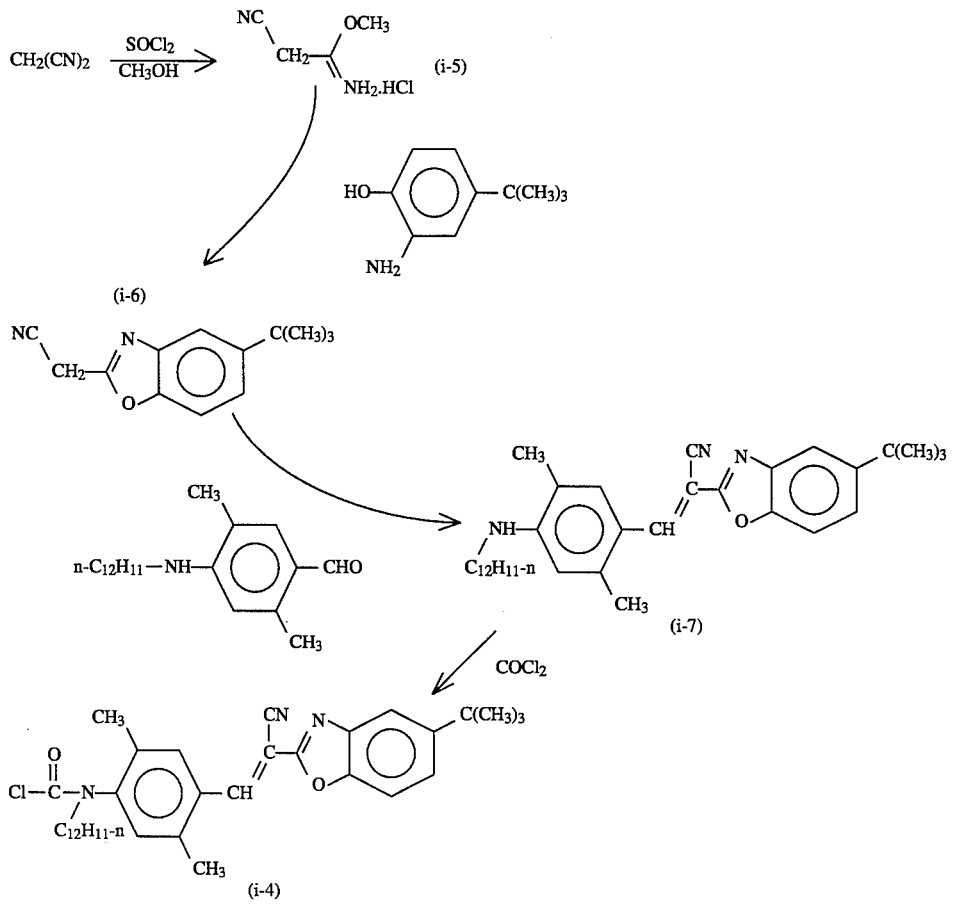

The dye intermediate i-4 is prepared according to Scheme 2, illustrated below. Commercially available 2,5-dimethyl aniline (50 g, 0.413 mole) is added to formic acid (46 g, 1 mole, 38 ml) in a round bottom flask fitted with a condenser and heating mantle. The mixture is heated to reflux for 2 hours and then cooled to room temperature before pouring into 2 liters of cold water with good stirring. The resulting precipitate is collected and air dried to yield 61 g of the formamide (2,5-dimethylformanilide). This formamide (59.6 g, 0.4 mole) and bromodecane (104.6 g, 0.4 mole) are mixed with 40 ml t-butanol and 400 ml THF in a 3-neck round bottom flask fitted with a reflux condenser, heating mantle, and nitrogen purge. The mixture is treated with potassium t-butoxide (49.2 g), heated to reflux for 12° hours, cooled to room temperature, and diluted with ethyl acetate. The mixture is then washed with excess 1N HCl and water. The organic layer is dried over $MgSO_4$ and concentrated to yield about 120 g of crude alkylated formamide. Alkylated formamide (120 g, 0.38 mole) is dissolved in 420 ml acetic acid and 120 ml 12N HCl and heated to reflux for 16 hours. The solvents are distilled off under vacuum and the resulting oil is slurried with 200 ml heptane to enhance precipitate formation. The precipitate is collected and air dried to yield 107 g of the corresponding amine hydrochloride (2,5-dimethyl-4-dodecylamino aniline hydrochloride). This amine hydrochloride (34.2 g, 0.0105 mole) is mixed with 250 ml acetic acid, 20 ml 12N HCl, and 20 ml formaldehyde in a large mouth 3-liter round bottom flask fitted with a mechanical stirrer and a heating mantle. The mixture is heated to about 80° C. before removing the heat and treating with N,N-dimethylnitrosoaniline (22.5 g, 0.15 mole) in portions over a ten minute interval with good stirring. The solvents are distilled off under vacuum and the resulting oil is dissolved in 300 ml of ethyl acetate and excess 2N HCl. The aqueous phase is washed an additional three times with 300 ml portions of ethyl acetate. These ethyl acetate extracts are passed through a pad of silica gel before removing solvent under vacuum to yield a slurry that crystallizes with the addition of 500 ml of heptane. The crystals are collected and air dried to yield 17 g of the aldehyde (2,5-dimethyl-4-dodecylamino-benzaldehyde; DMBA).

Commercially available 4-t-butyl phenol (30 g, 0.2 mole) is dissolved in 200 ml ethyl acetate in a 500 ml round bottom flask fitted with a mechanical stirrer, and cooled to 0° C. The mixture is treated with nitric acid (13 ml, in 13 ml water) dropwise over 10 minutes and then a catalytic amount of $NaNO_2$. After 45 minutes the reaction is washed with excess 1N HCl and the organic layer is dried over $MgSO_4$ and stripped to yield 37 g of 2-nitro-4 -t-butyl phenol. This nitrophenol (37 g, 0.19 mole) is dissolved in 100 ml ethyl acetate and placed into a parr bottle with a teaspoon of 10% Pd/C. The mixture is placed on a hydrogenator under 50 psi hydrogen with agitation for one hour. The catalyst is filtered off through celite, and the ethyl acetate is stripped off under vacuum. The material crystallizes with the addition of about 200 ml heptane to give 25.6 g of the corresponding amine (2-amino-4-t-butyl phenol).

Malononitrile (39.6 g, 0.6 mole) is dissolved in methanol (38 g, 1.2 mole, 48 ml) and 200 ml of methyl formate in a 1-liter 3-neck round bottom flask fitted with an ice bath and addition funnel. The mixture is cooled to 10° C. and treated dropwise over five minutes with thionyl chloride (55 g, 0.46 mole, 33.6 ml). A precipitate forms after 30 minutes and an additional 100 ml of methyl formate is added. After 1 hour the precipitate collected and air dried for 20 minutes to yield 52 g of the corresponding imine salt intermediate i-5. This salt is stored in an air-tight bottle purged with nitrogen. This imine salt (10.7 g, 0.08 mole) and 2-amino-4-t-butyl phenol (6.6 g, 0.04 mole) are heated with 100 ml methanol at 60° C. for 10 minutes before diluting with 200 ml of ethyl acetate and excess water. The organic layer is dried over $MgSO_4$ and stripped to yield 8.6 g of the benzoxazole i-6. This oil (4.5 g, 0.02 mole) and aldehyde DMBA (6.7 g, 0.02 mole) in 80 ml acetic acid and 3 drops of triethylamine are heated to 80° C. for 15 minutes and then stirred overnight at room temperature to give a slurry of crystals. The crystals are collected and washed with 100 ml methanol to give two crops yielding about 7 g of the methine-dye i-7. This dye (3.5 g, 0.0068 mole) is dissolved in about 25 ml methylene chloride and 2,6-lutidine (1.9 g, 0.017 mole). The mixture is treated with phosgene (1.93M in toluene, 0.014 mole, 7.2 ml) over a 1 minute interval. After 10 minutes the mixture is washed in a separatory funnel with excess cold 1N HCl, and then with cold water. The organic phase is dried over $MgSO_4$ and stripped to yield 3.7 g of the carbamoyl chloride i-4. After scale-up, this carbamoyl chloride (17.9 g, 0.031 mole) is reacted with coupler i-3 (29.3 g, 0.031 mole) in a 1-liter 3-neck round bottom flask fitted with nitrogen purge and containing dimethylamino pyridine (3.8 g, 0.031 mole) and 150 ml methylene chloride. The mixture is treated with DBU (14.1 g, 0.093 mole), stirred for 4 hours, diluted with ethyl acetate, and washed with excess 1N HCl and water. The organic layer is dried over $MgSO_4$ and concentrated to a crude oil that is chromatographed on silica gel using methylene chloride/heptane/ethyl acetate (5/3/2) as the eluent. About 20.5 g of Y-1 is obtained as a foam.

Coating Example

The Example coating structure, illustrated below as the Example Layer Structure, comprises several layers. The dye-receiving layer comprises polycarbonate and polycaprolactam and is coated on titania pigmented reflection paper base. This titania pigmented paper base is resin coated with high density polyethylene, and coated with a mixture of polycarbonate, polycapro-lactone, and 1,4-didecyloxy-2,5-dimethoxy benzene at a 0.77:0.115:0.115 weight ratio respectively, at a total coverage of 3.28 g/m$^2$. This polymeric dye-receiving layer is subjected to a corona discharge bombardment within 24 h prior to coating the example elements. The Dye-Receiving Layer is coated with about 30 mg/m$^2$ of stripping agent SA1.

A silver bromoiodide core-shell emulsion is precipitated having a nominal mole percent iodide content of 1%. The core is precipitated with about 2% iodide, on a mole percent basis, and the shell is pure silver bromide. This emulsion is prepared with a regular octahedral habit, and has a nominal particle size of about 0.3 μm. The shell has a thickness of about 0.03 μm. After washing, desalting, and addition of ossein gelatin, this semi-primitive emulsion, EM, is about 12.5% (w/v) silver and about 6% (w/v) gelatin.

| Example Layer Structure |
|---|
| Protective Overcoat |
| Green Sensitive Imaging Layer |
| Interlayer (2) |
| Red Sensitive Imaging Layer |
| Interlayer (1) |
| Blue-Sensitive Imaging Layer |
| Dye-Receiving Layer |
| Support |

A blue-sensitized emulsion is prepared by combining about 200 mL of EM with 3 mg of sodium thiosulfate, 0.4 mg of gold salt, and about 10 mg of ammonium thiocyanate. About 12 mL of a 1% solution of sensitizing dye SD-B in methanol is then added.

A red-sensitized emulsion is prepared similarly by combining about 200 mL of EM with 3 mg of sodium thiosulfate, 0.4 mg of gold salt, and about 10 mg of ammonium thiocyanate. About 12 mL of a 1% solution of sensitizing dye SD-R in methanol is then added.

A green-sensitized emulsion is prepared similarly by combining about 200 mL of EM with 4 mg of sodium thiosulfate, 0.4 mg of gold salt, and about 10 mg of ammonium thiocyanate. About 12 mL of a 1% solution of sensitizing dye SD-G in methanol is then added.

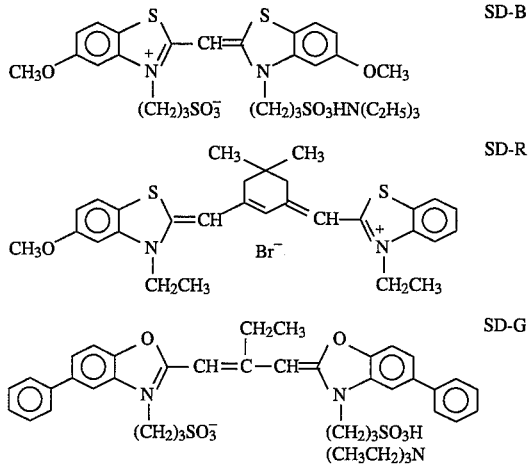

A silver 5-methylbenzotriazole (AgMBT) dispersion is prepared by combining about 29 g of AgMBT with 16 g of poly(N-vinyl pyrrolidone) (PVP) and about 1.3 g of sodium 4-sulfobenzotriazole in about 200 mL water at pH 5.5. This slurry is milled with zircon media for abut 3 days, filtered, and stored until used for coating.

A thermal solvent dispersion is prepared according to the following procedure: An aqueous solution is prepared at about 50° C. by combining 3.75 g of 10% (w/w) aqueous Alkanol XC (Du Pont), 30 g of 12.5% (w/w) gelatin, and 78.75 g water. About 12.5 g of 2'-ethylhexyl-4-hydroxy benzoate (EHHB) is added to this solution with stirring, and this coarse emulsion was then passed through a colloid mill five times to produce a fine particle sized dispersion. This thermal solvent dispersion of EHHB is then chill set and stored in the cold until used.

A dispersion of Y-1 is prepared by mixing a solution comprising 3 g of Y-1, about 50 mg of 2,5-di-t-octyl hydroquinone (DOH), and about 50 mg of stabilizer AF, and about 9 g of ethylacetate with an aqueous solution comprising about 3 g of 10% aqueous Alkanol-XC, about 19 g of 12.5% (w/w) gelatin, and about 46 g water. This mixture is passed through a colloid mill five times to obtain a fine particle dispersion of Y-1, and the resulting dispersion is chill set and stored in the cold until used.

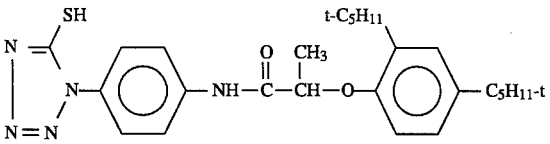

Dye-forming materials C-1 and M-1 are prepared by methods described in copending, commonly assigned U.S. application Ser. No. 07/927,691 of Texter et al., now U.S. Pat. No. 5,354,642.

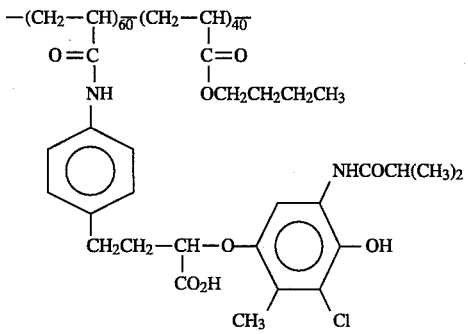

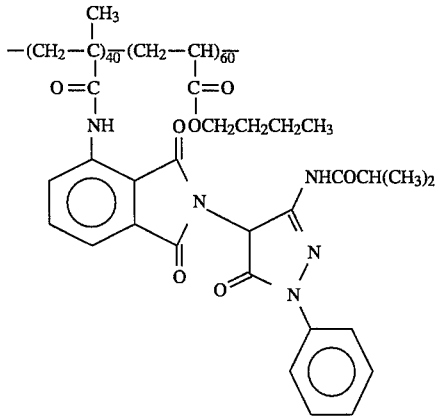

A dispersion of C-1 is prepared by combining about 90 g of C-1, 5 g of DOH, and about 5 g of stabilizer AF with about 200 mL of ethylacetate. This mixture is heated to dissolve the solids and is then mixed with about 720 mL of aqueous gelatin solution containing about 124 mL of 5% (w/w) aqueous Alkanol-XC and about 31 g of phenyl carbamoylated gelatin. This two-phase mixture is then dispersed using ultrasonic homogenization, and the ethylacetate is removed by rotary evaporation. The volume is adjusted to about 800 mL and the pH is adjusted to about 5.5.

A dispersion of M-1 is prepared by combining about 36 g of M-1, 5 g of 2,5-di-t-octyl hydroquinone (DOH), and about 5 g of stabilizer AF with about 200 mL of ethylacetate. This mixture is heated to dissolve the solids and is then mixed with about 720 mL of aqueous gelatin solution containing about 124 mL of 5% (w/w) aqueous Alkanol-XC and about 31 g of phenyl carbamoylated gelatin. This two-phase mixture is then dispersed using ultrasonic homogenization, and the ethylacetate is removed by rotary evaporation. The volume is adjusted to about 800 mL and the pH is adjusted to about 5.5.

A coating solution of reducing agent RA and heat solvent HS is prepared by dissolving about 23 g of RA, 1.1 g of HS, about 15 g of PVP, and about 0.5 g of the fluorinated dispersing aid DA (m and n independently are 2 or 3 in DA) in distilled water and adjusting the pH to about 5.5 and the final volume to about 250 mL.

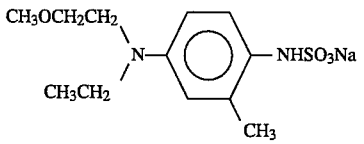

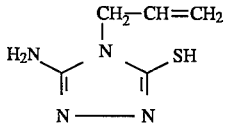

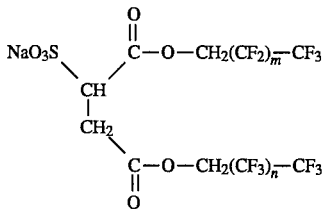

Dye-forming material ILP is prepared by methods described in copending, commonly assigned U.S. application Ser. No. 07/927,691 of Texter et al., now U.S. Pat. No. 5,360,695. This material is fabricated for use as an interlayer oxidized developer scavenger.

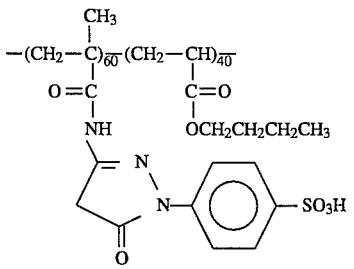

The blue-sensitive imaging layer is coated on the above described support and dye-receiving layer according to the following procedure: About 12.5 mL of the above described AgBMT dispersion of silver salt, about 10 mL of the above described blue-sensitized emulsion, about 2 g of gelatin, and about 12.5 mL of the above described RA/HS dispersion are combined at about 45° C. About 200 g of the above described methine-dye releasing Y-1 dispersion and about 40 g of the above described EHHB thermal solvent dispersion are combined with this silver halide, AgBMT, RA, and HS mixture. About 3.8 g of 300 molecular weight poly(ethylene oxide) is added as additional heat solvent. The gelatin is hardened with tetra(vinylsulfonyl-methyl)methane (TVSM). This melt is coated on the above described support and dye-receiving layer to yield a silver coverage of about 1.2 g/m$^2$.

The first interlayer is coated upon this blue-sensitive imaging layer. A coating melt for this first interlayer is prepared and coated so as to yield the following coverages: gelatin at 0.6 g/m$^2$; PVP at 0.3 g/m$^2$; AgBMT dispersion to yield AgBMT at 0.6 g/m$^2$; p-butoxybenzamide as heat solvent at 1.0 0.6 g/m$^2$; magenta dye-forming material ILP at 0.02 g/m$^2$.

The red-sensitive imaging layer is coated on the first interlayer according to the following procedure: About 12.5 mL of the above described AgBMT dispersion of silver salt, about 10 mL of the above described red-sensitized emulsion, about 2 g of gelatin, about 12.5 mL of the above described RA/HS dispersion, and about 40 mL of the above described C-1 dispersion are combined at about 45° C. About 3.8 g of 300 molecular weight poly(ethylene oxide) is added as additional heat solvent. The gelatin is hardened with tetra(vinylsulfonyl-methyl)methane (TVSM). This melt is coated on the first interlayer to yield a silver coverage of about 1.1 g/m$^2$. The heat solvent p-butoxybenzamide is added to yield a coverage of about 1 g/m$^2$. EHHB thermal solvent dispersion is added to yield a coverage of about 1 g/m$^2$.

Interlayer (2) is coated upon the red-sensitive imaging layer identically to the formulation and coverages described above for the first interlayer, Interlayer (1).

The green-sensitive imaging layer is coated on the first interlayer according to the following procedure: About 12.5 mL of the above described AgBMT dispersion of silver salt, about 10 mL of the above described red-sensitized emulsion, about 2 g of gelatin, about 12.5 mL of the above described RA/HS dispersion, and about 40 mL of the above described M-1 dispersion are combined at about 45° C. About 3.8 g of 300 molecular weight poly(ethylene oxide) is added as additional heat solvent. The gelatin is hardened with tetra(vinylsulfonyl-methyl)methane (TVSM). This melt is coated on the first interlayer to yield a silver coverage of about 1.2 g/m$^2$. The heat solvent p-butoxybenzamide is added to yield a coverage of about 1 g/m$^2$. EHHB thermal solvent dispersion is added to yield a coverage of about 1 g/m$^2$.

A protective overcoat layer is coated upon the green-sensitive imaging layer. The coated composition yielded gelatin at about 0.28 g/m$^2$and PVP at about 0.14 g/m$^2$. Additional TVSM is added to harden the overcoat and interlayer gelatin.

This example coating is given a blue light exposure of about 1000 CMS through a 0–3 density 21-step tablet. This exposed coating is then heat developed for about 1 minute at about 115° C. using a heat developing machine with developer module 272 (3M Company). After heat development, the donor layers comprising the blue-sensitive imaging layer, interlayer (1), red-sensitive imaging layer, interlayer (2), green sensitive imaging layer, and protective overcoat layer are stripped away from the receiver member (dye-receiving layer and support) using the method described by Texter et al. in U.S. Pat. No. 5,164,280. The resulting graduated yellow methine-dye image on the receiver member has low Dmin and a Dmax in excess of 2 as measured by reflection densitometry.

The present invention has been described in some detail with particular reference to preferred embodiments thereof. It will be understood that variations and modifications can be effected within the spirit and scope of the present invention.

What is claimed is:

1. A heat-developable photographic color diffusion transfer element comprising a dimensionally stable support and one or more layers comprising radiation sensitive silver halide, an organic silver salt oxidizing agent, a reducing agent, a methine-dye releasing compound, and a binder, wherein said methine-dye is heat diffusible in said element, and wherein said methine-dye releasing compound is of the structure $$Cp—L—M \qquad (I)$$

where

Cp is a coupler radical substituted in the coupling position with a divalent linking group, L;

M is a methine-dye radical exhibiting selective absorption in the visible spectrum; and where the bond connecting M to L does not terminate in an oxygen atom; and where the —L—M group couples off upon reaction of said coupler radical with the oxidation product of a primary amine developing agent, and where said methine-dye radical M is released from said —L—M group subsequent to the coupling off of said —L—M group.

2. A heat-developable photographic color diffusion transfer element comprising a dimensionally stable support and one or more layers comprising radiation sensitive silver halide, an organic silver salt oxidizing agent, a reducing agent, a methine-dye releasing compound, a thermal solvent for facilitating the thermal diffusion of methine-dye through hydrophilic binder, and a hydrophilic binder, wherein said methine-dye is heat diffusible in said binder and thermal solvent, and wherein said methine-dye releasing compound is of the structure $$Cp—L—M \qquad (I)$$

where

Cp is a coupler radical substituted in the coupling position with a divalent linking group, L;

M is a methine-dye radical exhibiting selective absorption in the visible spectrum; and where the —L—M group couples off upon reaction of said coupler radical with the oxidation product of a primary amine developing agent; and where said methine-dye radical M is given by structure (II):

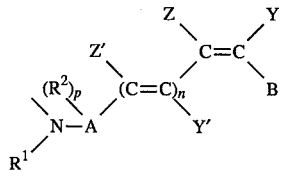

(II)

wherein $R^1$ is hydrogen or a substituted or unsubstituted alkyl, aryl, or heteroaryl group;

A is a substituted or unsubstituted aryl or heteroaryl ring;

each $R^2$ is independently a substituted or unsubstituted alkyl group which may form a ring with Z' or Z when n=O;

p is an integer from 0 to 3;

each Z, Z', and Y' is independently hydrogen or a substituent;

Y is an electron withdrawing group;

n is 0, 1, or 2; and

B is a heterocycle having the formula (III):

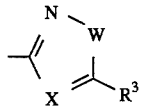

(III)

wherein:

X is O, S, or N($R^5$) where $R^5$ is hydrogen or alkyl;

W is N or C($R^4$) where $R^4$ is hydrogen or a substituent;

$R^3$ is a substituent linked to the heterocycle by a carbon or nitrogen atom of the substituent;

provided that $R^3$ and $R^4$ may be linked to form a ring.

3. A heat-developable photographic color diffusion transfer element comprising a dimensionally stable support and one or more layers comprising radiation sensitive silver halide, an organic silver salt oxidizing agent, a reducing agent, a methine-dye releasing compound, a thermal solvent for facilitating the thermal diffusion of methine-dye through hydrophilic binder, and a hydrophilic binder, wherein said methine-dye is heat diffusible in said binder and thermal solvent, and wherein said methine-dye releasing compound is of the structure

*Cp—L—M* (I)

where

Cp is a coupler radical substituted in the coupling position with a divalent linking group, L;

M is a methine-dye radical exhibiting selective absorption in the visible spectrum; and where the —L—M group couples off upon reaction of said coupler radical with the oxidation product of a primary amine developing agent, and where said methine-dye radical M is released from said —L—M group subsequent to the coupling off of said —L—M group; and where said linking group L comprises at least one of L-2, L-3, L-4, L-5, L-6, L-7, L-8, L-9, L-10, L-11, L-12, L-13, and L-14:

L-2

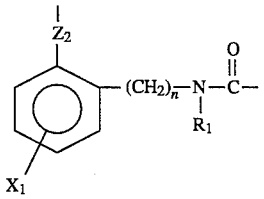

L-3

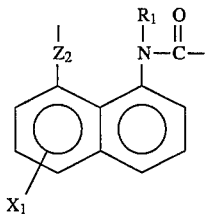

where n is 0 or 1;

L-4

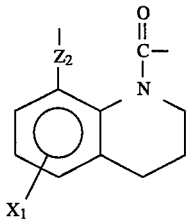

L-5

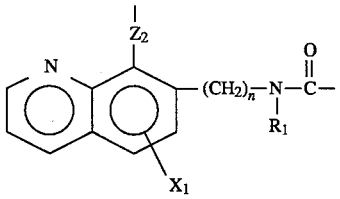

where n is 0 or 1;

L-6

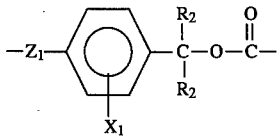

L-7

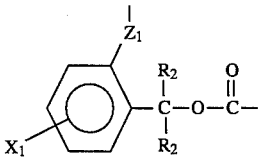

L-8

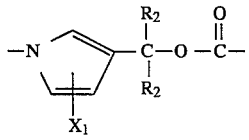

L-9

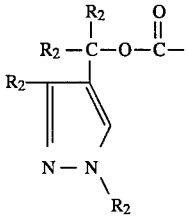

L-10

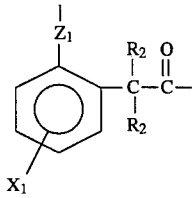

-continued

L-11

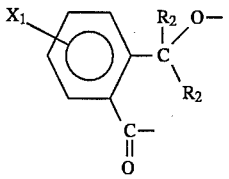

L-12

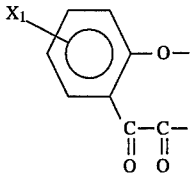

L-13

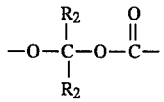

L-14

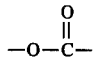

wherein $Z_1$ is

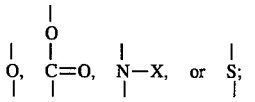

where X is a substituent;

$Z_2$ is

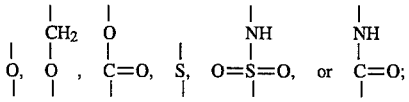

$Z_3$ is

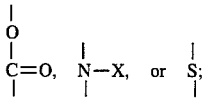

where X is a substituent;

$R_1$ is hydrogen, alkyl of 1 to 20 carbon atoms, or aryl of 6 to 30 carbon atoms;

each $R_2$ independently is hydrogen, alkyl of 1 to 25 carbon atoms, cycloalkyl, substituted cycloalkyl, or aryl of 6 to 30 carbon atoms;

$X_1$ is hydrogen, cyano, fluoro, chloro, bromo, iodo, nitro, alkyl of 1 to 20 carbon atoms, aryloxy, alkoxycarbonyl, hydroxy, sulfonyl, acyl, alkoxy, sulfo, $—OR_2$, $—COOR_2$, $—CONHR_2$, $—NHCOR_2$, $—NHSO_2R_2$, $—SO_2NHR_2$, or $—SO_2R_2$.

4. An element as in claim 1, wherein said methine-dye radical M is given by structure (II):

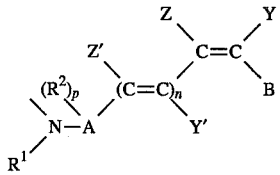

(II)

wherein $R^1$ is hydrogen or a substituted or unsubstituted alkyl, aryl, or heteroaryl group;

A is a substituted or unsubstituted aryl or heteroaryl ring;

each $R^2$ is independently a substituted or unsubstituted alkyl group which may form a ring with Z' or Z when n=O;

p is an integer from 0 to 3;

each Z, Z', and Y' is independently hydrogen or a substituent;

Y is an electron withdrawing group;

n is 0, 1, or 2; and

B is a heterocycle having the formula (III):

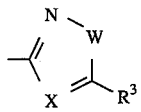

(III)

wherein:

X is O, S, or $N(R^5)$ where $R^5$ is hydrogen or alkyl;

W is N or $C(R^4)$ where $R^4$ is hydrogen or a substituent;

$R^3$ is a substituent linked to the heterocycle by a carbon or nitrogen atom of the substituent;

provided that $R^3$ and $R^4$ may be linked to form a ring.

5. An element as in claim 3, wherein said methine-dye radical M is given by structure (II):

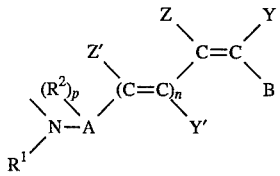

(II)

wherein $R^1$ is hydrogen or a substituted or unsubstituted alkyl, aryl, or heteroaryl group;

A is a substituted or unsubstituted aryl or heteroaryl ring;

each $R^2$ is independently a substituted or unsubstituted alkyl group which may form a ring with Z' or Z when n=O;

p is an integer from 0 to 3;

each Z, Z', and Y' is independently hydrogen or a substituent;

Y is an electron withdrawing group;

n is 0, 1, or 2; and

B is a heterocycle having the formula (III):

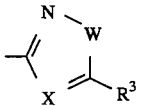

(III)

wherein:

X is O, S, or $N(R^5)$ where $R^5$ is hydrogen or alkyl;

W is N or $C(R^4)$ where $R^4$ is hydrogen or a substituent;

$R^3$ is a substituent linked to the heterocycle by a carbon or nitrogen atom of the substituent;

provided that $R^3$ and $R^4$ may be linked to form a ring.

6. An element as in claim 1, wherein said linking group L comprises at least one of L-1, L-2, L-3, L-4, L-5, L-6, L-7, L-8, L-9, L-10, L-11, L-12, L-13, and L-14:

L-1

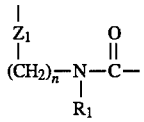

where n is 1, 2, 3, or 4;

L-2

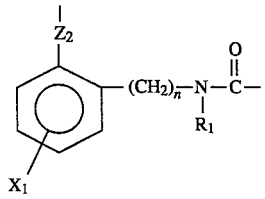

L-3

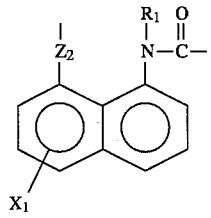

where n is 0 or 1;

L-4

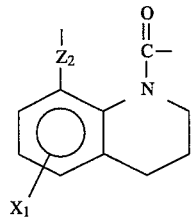

L-5

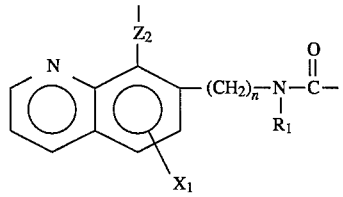

where n is 0 or 1;

L-6

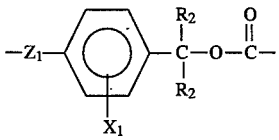

L-7

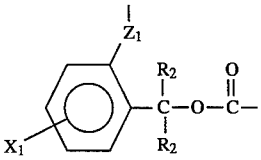

L-8

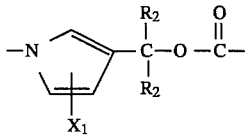

L-9

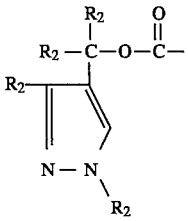

L-10

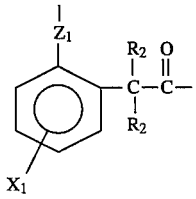

L-11

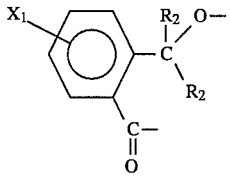

L-12

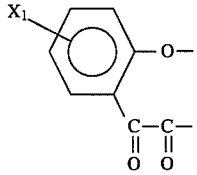

L-13

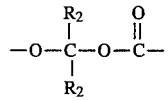

L-14

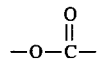

wherein $Z_1$ is

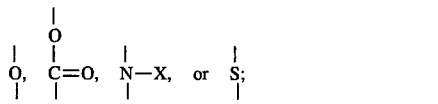

where X is a substituent;

$Z_2$ is

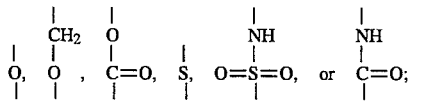

$R_1$ is hydrogen, alkyl of 1 to 20 carbon atoms, or aryl of 6 to 30 carbon atoms;

each $R_2$ independently is hydrogen, alkyl of 1 to 25 carbon atoms, cycloalkyl, substituted cycloalkyl, or aryl of 6 to 30 carbon atoms;

$X_1$ is hydrogen, cyano, fluoro, chloro, bromo, iodo, nitro, alkyl of 1 to 20 carbon atoms, aryloxy, alkoxycarbonyl, hydroxy, sulfonyl, acyl, alkoxy, sulfo, $—OR_2$, $—COOR_2$, $—CONHR_2$, $—NHCOR_2$, $—NHSO_2R_2$, $—SO_2NHR_2$, or $—SO_2R_2$.

7. An element as in claim 2, wherein said coupling radical Cp is substituted with aqueous solubilizing groups.

8. An element as in claim 1, which in addition contains a dye-receiving layer intermediate said support and said silver halide containing and said dye-releasing coupler containing layers.

9. An element as in claim 2, which in addition contains a dye-receiving layer intermediate said support and said silver halide containing and said dye-releasing coupler containing layers.

10. An element as in claim 3, which in addition contains a dye-receiving layer intermediate said support and said silver halide containing and said dye-releasing coupler containing layers.

11. An element as in claim 1, which in addition contains a dye-receiving layer intermediate said support and said silver halide containing and said dye-releasing coupler containing layers, and further contains a stripping layer intermediate said dye-receiving layer and said silver halide containing and said dye-releasing coupler containing layers.

12. An element as in claim 9, which in addition contains a stripping layer intermediate said dye-receiving layer and said silver halide containing and said dye-releasing coupler containing layers.

13. An element as in claim 10, which in addition contains a stripping layer intermediate said dye-receiving layer and said silver halide containing and said dye-releasing coupler containing layers.

14. An element as in claim 1, which in addition contains a dye-receiving layer intermediate said support and said silver halide containing and said dye-releasing coupler containing layers, and further contains a stripping layer intermediate said dye-receiving layer and said silver halide containing and said dye-releasing coupler containing layers, wherein said stripping layer comprises a stripping agent of the following formula:

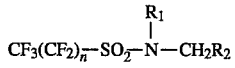

wherein $R_1$ is alkyl having from 1 to 6 carbon atoms, substituted alkyl having from 1 to 6 carbon atoms, aryl having from 6 to 10 carbon atoms, or substituted aryl having from 6 to 10 carbon atoms; $R_2$ is

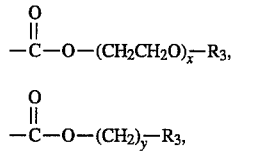

$R_3$ is H or $R_1$; n is an integer from 4 to 19; x and y each independently represents an integer of from 2 to 50; and z represents an integer of from 1 to 50.

15. An element as in claim 12, wherein said stripping layer comprises a stripping agent of the following formula:

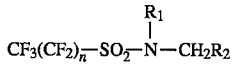

wherein $R_1$ is alkyl having from 1 to 6 carbon atoms, substituted alkyl having from 1 to 6 carbon atoms, aryl having from 6 to 10 carbon atoms, or substituted aryl having from 6 to 10 carbon atoms; $R_2$ is

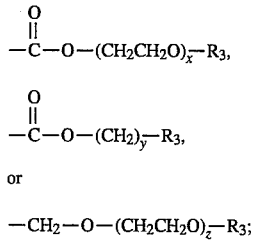

$R_3$ is H or $R_1$; n is an integer from 4 to 19; x and y each independently represents an integer of from 2 to 50; and z represents an integer of from 1 to 50.

16. An element as in claim 13, wherein said stripping layer comprises a stripping agent of the following formula:

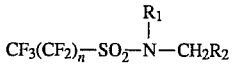

wherein $R_1$ is alkyl having from 1 to 6 carbon atoms, substituted alkyl having from 1 to 6 carbon atoms, aryl having from 6 to 10 carbon atoms, or substituted aryl having from 6 to 10 carbon atoms; $R_2$ is $$-\overset{O}{\overset{\|}{C}}-O-(CH_2CH_2O)_x-R_3,$$

$$-\overset{O}{\overset{\|}{C}}-O-(CH_2)_y-R_3,$$

or $$-CH_2-O-(CH_2CH_2O)_z-R_3;$$

$R_3$ is H or $R_1$; n is an integer from 4 to 19; x and y each independently represents an integer of from 2 to 50; and z represents an integer of from 1 to 50.

17. An element as in claim 2, wherein said thermal solvent comprises at least one compound according to structure (V):

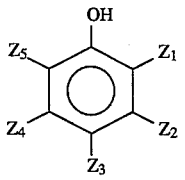

(V)

wherein (a) $Z_1$, $Z_2$, $Z_3$, $Z_4$, and $Z_5$ are substituents, the Hammet sigma parameters of $Z_2$, $Z_3$, and $Z_4$ sum to give a total, Σ, of at least −0.28 and less than 1.53;

(b) the calculated logP for (V) is greater than 3 and less than 10.

18. An element as in claim 3, wherein said thermal solvent comprises at least one compound according to structure (V):

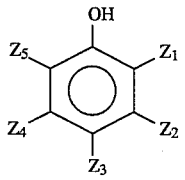

(V)

wherein (a) $Z_1$, $Z_2$, $Z_3$, $Z_4$, and $Z_5$ are substituents, the Hammet sigma parameters of $Z_2$, $Z_3$, and $Z_4$ sum to give a total, Σ, of at least −0.28 and less than 1.53;

(b) the calculated logP for (V) is greater than 3 and less than 10.

19. An element as in claim 1, which further comprises a thermal solvent for facilitating thermal dye transfer of said methine-dye through said binder.

20. An element as in claim 19, wherein said thermal solvent comprises at least one compound according to structure (V):

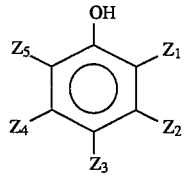

(V)

wherein (a) $Z_1$, $Z_2$, $Z_3$, $Z_4$, and $Z_5$ are substituents, the Hammer sigma parameters of $Z_2$, $Z_3$, and $Z_4$ sum to give a total, Σ, of at least −0.28 and less than 1.53;

(b) the calculated logP for (V) is greater than 3 and less than 10.

21. An element as in claim 1, wherein said methine-dye radical M attaches to said linking group L by a bond terminating in a nitrogen atom.

22. An element as in claim 2, wherein said methine-dye radical M attaches to said linking group L by a bond terminating in a nitrogen atom.

23. An element as in claim 3, wherein said methine-dye radical M attaches to said linking group L by a bond terminating in a nitrogen atom.

24. An element as in claim 1, wherein said coupling radical Cp is substituted with aqueous solubilizing groups.

25. An element as in claim 3, wherein said coupling radical Cp is substituted with aqueous solubilizing groups.

26. An element as in claim 7, wherein said coupling radical Cp is substituted with an aqueous solubilizing group selected from the group consisting of carboxy groups and sulfo groups.

* * * * *